US006296377B1

(12) United States Patent
Wilson et al.

(10) Patent No.: US 6,296,377 B1
(45) Date of Patent: Oct. 2, 2001

(54) CONVERTIBLE MODULAR LANTERN

(75) Inventors: Robert E. Wilson, Atlantic Beach; Jason D. Patz; Laszlo Henry Martini, both of Jacksonville; Robert J. Pape, Ponte Vedra Beach, all of FL (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 09/435,930

(22) Filed: Nov. 9, 1999

Related U.S. Application Data

(60) Provisional application No. 60/108,407, filed on Nov. 13, 1998.

(51) Int. Cl.[7] ..... F21V 21/02

(52) U.S. Cl. ..... 362/370; 362/249; 362/147; 362/367; 362/432; 439/220; 439/537

(58) Field of Search ..... 362/226, 227, 362/235, 249, 147, 362, 368, 382, 432, 370, 367; 439/220, 542, 543, 537, 576, 214

(56) References Cited

U.S. PATENT DOCUMENTS

| | | | | |
|---|---|---|---|---|
| D. 314,834 | | 2/1991 | Rottner | D26/87 |
| D. 388,219 | | 12/1997 | Hsu | D26/87 |
| D. 388,906 | | 1/1998 | Chiang | D26/85 |
| 3,863,236 | | 1/1975 | Clardy | 340/326 |
| 4,079,244 | * | 3/1978 | Bortoluzzi | 362/432 |
| 4,528,620 | * | 7/1985 | Weber | 362/368 |
| 4,635,168 | | 1/1987 | Crowley | 362/147 |
| 5,006,968 | | 4/1991 | Miller | 362/147 |
| 5,111,370 | * | 5/1992 | Clark | 362/147 |
| 5,376,020 | * | 12/1994 | Jones | 439/537 |
| 5,590,953 | | 1/1997 | Haslam et al. | 362/276 |

* cited by examiner

*Primary Examiner*—Alan Cariaso
(74) *Attorney, Agent, or Firm*—Baker, Donelson, Bearman & Caldwell

(57) ABSTRACT

A convertible modular lantern is provided which includes a mount assembly, mountable to a structure, a housing supported by the mount assembly, a downrod and light cluster assembly connected to the housing and a shade assembly attached to the housing and disposed in surrounding relationship with the downrod and light cluster assembly. The shade assembly may include a plurality of light transmitting panels. The downrod and light cluster assembly includes at least one lamp socket mounted on a support member, with a light bulb disposed in each socket, and a hollow downrod attached to and extending upwardly from the support member. A first plurality of wires is electrically coupled at one end to each socket and extends upwardly within the downrod, terminating at the opposite end in an upper electrical connector. A second plurality of wires is provided which is also coupled at one end to each socket and terminates, at the opposite end, in a lower electrical connector. The lantern further includes a third electrical connector which is engaged with and electrically connected to one of the upper and lower electrical connectors, depending upon the desired configuration of the lantern. The lantern may further include a second housing, with one housing attached to an upper portion of the shade assembly and the other housing attached to the lower portion of the shade assembly. The lantern may also include one or more decorative finials or a decorative tail.

45 Claims, 23 Drawing Sheets

CONVERTIBLE MODULAR LANTERN

CROSS-REFERENCES

The subject application claims the priority benefit of U.S. Provisional patent application having Ser. No. 60/108,407, filed on Nov. 13, 1998, entitled: "Convertible Modular Lantern".

BACKGROUND

1. Field of the Invention

The present invention relates generally to lighting fixtures and, more particularly, to a wall-mountable lantern for indoor or outdoor use.

2. Related Art

Wall-mounted outdoor lanterns have become an increasingly popular means of providing supplemental lighting for both commercial and residential buildings and for enhancing the exterior appearance of the buildings. Wall-mounted outdoor lanterns typically include a mounting assembly having a mount plate which is attached to and interfaces with an electrical junction box included in the residential or commercial structure, and a hollow arm protruding from the mount plate. Electrical wiring is routed from the junction box through the hollow arm to the light fixture included in the lantern.

Wall-mounted outdoor lanterns may generally be subdivided into the following two classifications: standard or low outlet configuration; and high outlet configuration. With standard or low outlet configuration lanterns, the arm of the mounting assembly is mechanically attached to a lower portion of the lantern housing which contains the included light fixture, with the electrical wiring entering the lantern through a lower portion of the lantern housing. An example of a standard or low outlet lantern is illustrated in U.S. Pat. No. Des. 388,219, issued to Hsu.

With high outlet lanterns, the mounting assembly is mechanically connected to an upper portion of the lantern housing with the electrical wiring entering the lantern through the upper portion of the housing. An example of a high outlet lantern is illustrated in U.S. Pat. No. Des. 314,834 issued to Rottner.

Wholesale and retail purchasers of wall mounted lanterns often require a wide variety of configurations or "looks" in order to satisfy their customers. For instance, in a residential subdivision, an electrician may be required to install a wide variety of outdoor lanterns to satisfy the desire of one or more home purchasers to have a distinctive exterior appearance for their home. However, although conventional outdoor lanterns offer some variation in appearance, for instance by replacing a finial with a tail assembly, they are relatively inflexible with regard to achieving a variety of configurations from the same basic lantern. As an example, with conventional wall-mounted outdoor lanterns which are known by the inventors, the electrical wires leading from the electrical junction box are "hard wired" to the light fixture included in the lantern. This feature does not permit the lantern to be converted from a low to a high outlet configuration, or vice versa, while retaining the light fixture in the same position, without rewiring the lantern which requires a professional and is generally not practical. Rotating the lantern 180° to change the lantern from a low to a high outlet configuration, or vice versa, is also generally not practical. In the first instance, known lanterns typically are not symmetrical with regard to the included upper and lower portions, thereby preventing such a rotation. In the second instance, even if the lantern has such symmetry, this rotation would result in a changed position of the included lamp sockets and light bulbs, since the lamp sockets are hard wired. For instance, bulbs originally disposed in a "base-down" burning configuration would be changed to a "base-up" burning configuration. When candelabra based light bulbs are used, a base-up burning configuration is generally considered to be unacceptable since this configuration adversely affects the service life of the light bulbs due to overheating of the light bulbs.

Additionally, although conventional outdoor lanterns are known to include either open or closed bottom configurations, the inventors are unaware of any existing lantern which is available in both configurations.

SUMMARY

In view of the foregoing needs, the present invention is directed to a convertible modular lantern which may be mounted to the electrical junction box of a residential or commercial structure. Alternatively, the convertible modular lantern may be mounted directly to a wall of the residential or commercial structure if desired, or necessary, for instance due to the absence of an electrical junction box in older structures. Although the convertible modular lantern of the present invention may be advantageously utilized in either indoor or outdoor applications, the convertible modular lantern of the present invention has particular application for outdoor use. The convertible modular lantern of the present invention may be configured as either a high outlet or a low outlet lantern, may have an open bottom or a closed bottom and may include either a decorative finial or a tail assembly attached to and extending below a lower housing of the configurations including a closed bottom. Each configuration of the convertible modular lantern may be converted from a high outlet to a low outlet configuration, or vice versa, due to the incorporation of a downrod and light cluster assembly which has upper and lower electrical connectors which are selectively connected to a mating connector coupled to the source of 120 vac electrical power of the structure, for instance via connection with the electrical wires leading from the junction box of the structure to which the lantern is mounted. For instance, if a standard, or low outlet configuration is desired, the connector coupled to the source of 120 vac electrical power of the structure is connected to the lower connector of the downrod and light cluster assembly. Alternatively, if a high outlet configuration is desired, the connector coupled to the source of 120 vac electrical power is connected to the upper connector of the downrod and light cluster assembly. The incorporation of the downrod and light cluster assembly in each embodiment of the modular lantern of the present invention, combined with the mating connector and associated wiring, allows the lantern to be converted from high a outlet to low outlet configuration, or vice versa, while retaining the included lamp sockets disposed toward the bottom end of the lantern shade assembly and oriented such that the included light bulbs are in a "base-down" burning configuration, as opposed to a base-up burning configuration. This is particularly important when candelabra based light bulbs are used. Candelabra based light bulbs have a significantly increased service life when operated in a base-down burning configuration due to heat problems associated with a base-up burning configuration which causes the bulbs to overheat, thereby adversely affecting the service life of the candelabra based light bulbs.

Additionally, the use of interchangeable parts in the various embodiments of the convertible modular lantern of the present invention allow a user to create a wide variety of distinctly different "looks" or variations of the lantern. At least five different basic configurations may be achieved, corresponding to the below listed configurations, with additional variations achieved by substituting alternate finial designs and materials of construction:

high outlet, with open bottom;

high outlet, with closed bottom and finial attached to the lower housing;

high outlet, closed bottom with tail assembly attached to the lower housing;

low outlet, closed bottom with tail assembly attached to the mount assembly proximate the lower housing; and low outlet, closed bottom with finial attached to the mount assembly proximate the lower housing.

This ability to create a wide variety of different looks or variations of an outdoor lantern is extremely important to a retailer who would have to stock at least three and possibly five different lanterns to achieve the various looks or variations that are possible with the modular lantern of the present invention, if the retailer were to use existing conventional lanterns. This allows the retailer to save shelf space and sell other profitable products. This is referred to in the art as "s.k.u. reduction" and is very important as it greatly increases the value of the retailer's shelf space. The convertible modular lantern of the present invention is also valuable to wholesale customers who sell to professionals who install the lantern on residential homes. Using conventional lanterns, an electrician would typically have to purchase many different styles of lanterns to achieve the varying configurations of the convertible modular lantern of the present invention, which may be required in a new subdivision for instance where a variety of a distinctly different lanterns are desirable.

According to a first aspect of the present invention, a convertible modular lantern is provided, for either indoor or outdoor use. In a first embodiment the lantern includes a mount assembly, a housing connected to and supported by the mount assembly, a downrod and light cluster assembly mechanically connected to the housing, and a shade assembly attached to the housing and disposed in surrounding relationship with the downrod and light cluster assembly, with at least a portion of the shade assembly permitting the transmission of light therethrough. The downrod and light cluster assembly includes a support member and at least one lamp socket mounted on the support member. A light bulb is disposed in each of the lamp sockets, and the downrod and light cluster assembly further includes a hollow downrod attached to and extending upwardly from the support member. The downrod and light cluster assembly also includes upper and lower electrical connectors, each being electrically coupled to each of the lamp sockets. The upper electrical connector is electrically coupled to each socket via a first plurality of wires which are electrically coupled at one end thereof to each of the lamp sockets and extend upwardly within the hollow downrod, terminating in the upper electrical connector. The lower electrical connector is coupled to each lamp socket via a second plurality of wires coupled at one end thereof to each of the lamp sockets. The lantern further includes a third electrical connector which is engaged with and electrically connected to one of the upper and lower electrical connectors, depending upon the desired configuration of the lantern.

Preferably, the upper and lower electrical connectors, as well as the third electrical connector, each comprise an electrical block connector. Even more preferably, due to safety considerations, the upper and lower electrical connectors and the third electrical connector each comprise a keyed, electrical block connector. In one preferred embodiment, both the upper and lower electrical connectors comprise a female, keyed electrical block connector, with the third electrical connector comprising a male, keyed electrical block connector. However, the opposite configuration is considered to be within the scope of the present invention, i.e., with the upper and lower electrical connectors each comprising a male connector such as a male, keyed electrical block connector, with the third electrical connector comprising a female connector such as a female, keyed electrical block connector.

In one embodiment, the housing comprises an upper housing, with the mount assembly being connected to an upper portion of the upper housing, to provide a high outlet lantern configuration. In this embodiment, the third electrical connector is electrically connected to the upper electrical connector, and the lantern may further include a decorative finial attached to the mount assembly proximate the upper housing. A bottom portion of the included shade assembly may be open to provide a high outlet, open bottom configuration.

In yet another embodiment, the lantern may further include a lower housing attached to a lower portion of the shade assembly, to provide a high outlet, closed bottom configuration. In this embodiment, a second decorative finial may be attached to the lower housing. Alternatively, a tail may be attached to and extend downwardly from the lower housing.

In another embodiment, the housing comprises a lower housing, with the mount assembly being attached to a lower portion of the lower housing, to achieve a low outlet, closed bottom configuration. In this embodiment, the third electrical connector is electrically connected to the lower electrical connector. With this configuration, the lantern further includes an upper housing attached to an upper portion of the shade assembly and a decorative finial attached to an upper portion of the upper housing. A second decorative finial may be attached to the mount assembly proximate the lower housing. Alternatively, a tail may be attached to the mount assembly proximate the lower housing.

With each of the foregoing configurations, the mount assembly may include a hollow backplate and a hollow arm connected to and extending away from the backplate, with a distal end portion of the arm being attached to either the upper or lower housing, depending upon the particular configuration of the lantern. For instance in the case of a high outlet configuration, the distal end portion of the arm is attached to the upper housing, whereas it is attached to the lower housing for low outlet configurations. The hollow backplate and hollow arm are preferably made as a one piece construction, and may comprise a one piece casting. The third plurality of wires which are connected to and extend away from the third connector are routed through the hollow arm and hollow backplate of the mount assembly.

Further, in each of the foregoing configurations, the shade assembly may have a polygonal cross-sectional shape, such as a hexagonal cross-sectional shape. Further, the shade assembly may include a frame and a plurality of light transmitting panels, with the frame being attached to each housing of the particular lantern configuration. For instance, the frame may include an upper and lower flange, with the upper flange being attached to the upper housing and the lower flange being attached to the lower housing, when used. The shade assembly frame may further include a plurality of substantially vertically extending members attached to and interconnecting the upper and lower flanges, with each of these members being disposed between an adjacent pair of the light transmitting panels. Further, in one embodiment, the lantern includes three of the lamp sockets and a candelabra based light bulb disposed in each socket.

The downrod is attached at a lower end thereof to the support member, which may comprise a plate. The downrod and light cluster assembly may further include a hollow inner cup attached to the support member, with the inner cup including an aperture formed therethrough. The second plurality of wires is routed through the aperture, whereby the lower electrical connector is disposed exterior of the inner cup. In the embodiments corresponding to high outlet configurations, the downrod and light cluster assembly may further include a hollow outer cup which is disposed in surrounding relationship with the inner cup and is attached to a lower end of the inner cup. The inner and outer cups form a cavity therebetween, with the lower electrical connector being disposed in the cavity. Preferably, the outer cup is not included in those embodiments corresponding to a low outlet configuration lantern.

The hollow backplate of the mount assembly may be mounted to the electrical junction box of a residential or commercial structure, with the third plurality of wires being electrically connected to the source of 120 vac power of the structure, thereby operatively illuminating the light bulbs disposed in the lamp sockets. The third plurality of wires extending from the third electrical connector may be routed through the hollow interior Of the mount assembly to the source of 120 vac electrical power of the structure. As evidenced from the foregoing, the lantern of the present invention is configured to provide a quick and simple mounting to the residential or commercial structure and electrical connection to the source of 120 vac electrical power of the structure.

According to a second aspect of the present invention, a kit of lantern parts is provided which permits the end user to achieve at least five different basic configurations, corresponding to the various high and low outlet configurations discussed previously. The kit of parts may include a mount assembly, at least one housing, which may comprise both an upper and a lower housing, a shade assembly and a downrod and light cluster assembly which includes at least one lamp socket mounted on a support member and a light bulb disposed in each socket. The downrod and light cluster assembly further includes a hollow downrod attached to and extending away from the support member and upper and lower electrical connectors, each being electrically coupled to each of the lamp sockets. The kit further includes a third electrical connector which may be operatively engaged with one of the upper and lower connectors. The kit may further include at least one decorative finial, at least one tail and sufficient fasteners to attach the foregoing components to one another. For instance, the fasteners may include a plurality of open couplings, a plurality of threaded nipples, and a plurality of threaded screws.

BRIEF DESCRIPTION OF THE DRAWINGS

These and other features, aspects, and advantages of the present invention will become better understood with regard to the following description, appended claims and accompanying drawings, wherein:

DETAILED DESCRIPTION

Figure 1:
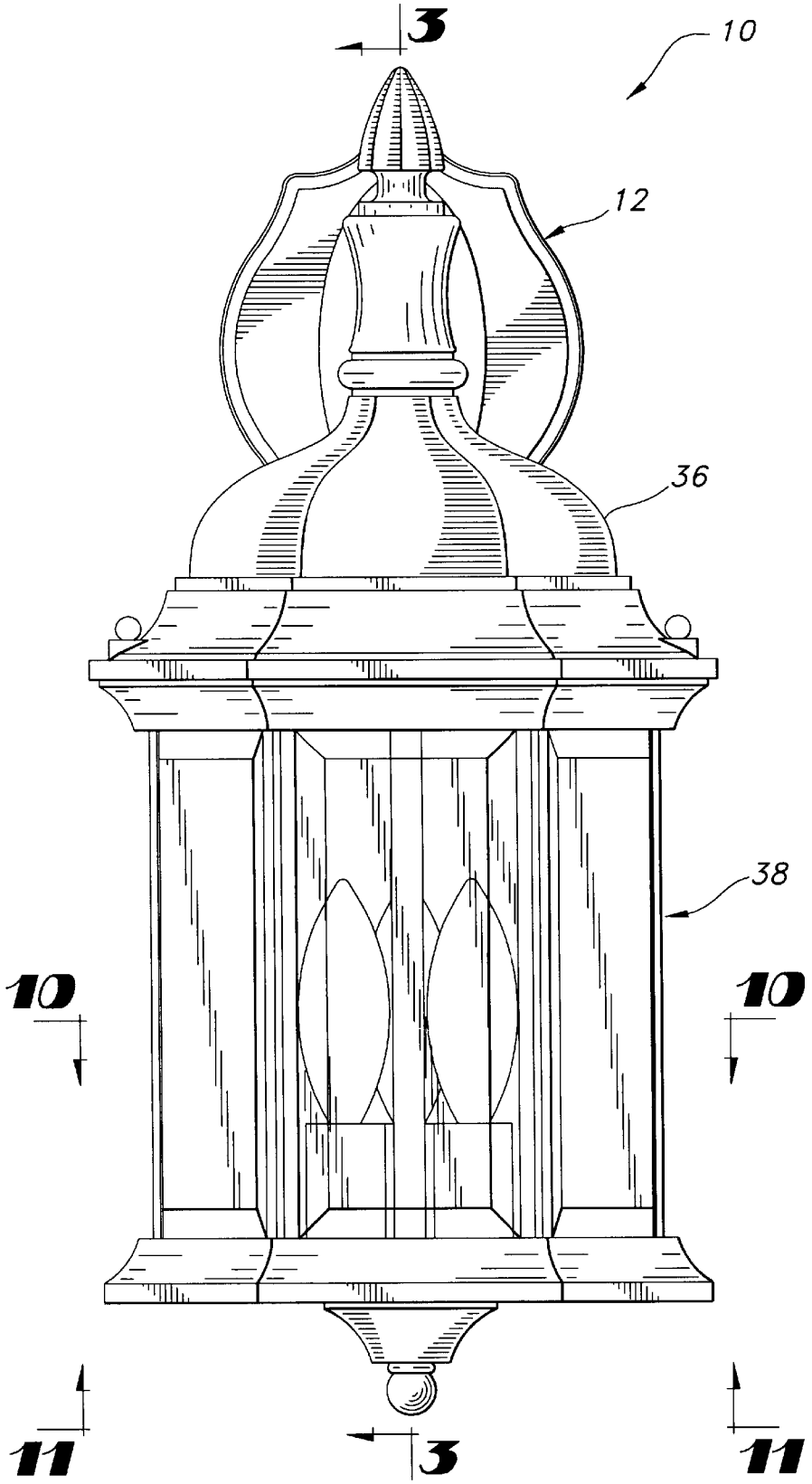
FIG. 1 is a front elevational view illustrating a convertible modular lantern according to a first embodiment of the present invention.
Figure 2:
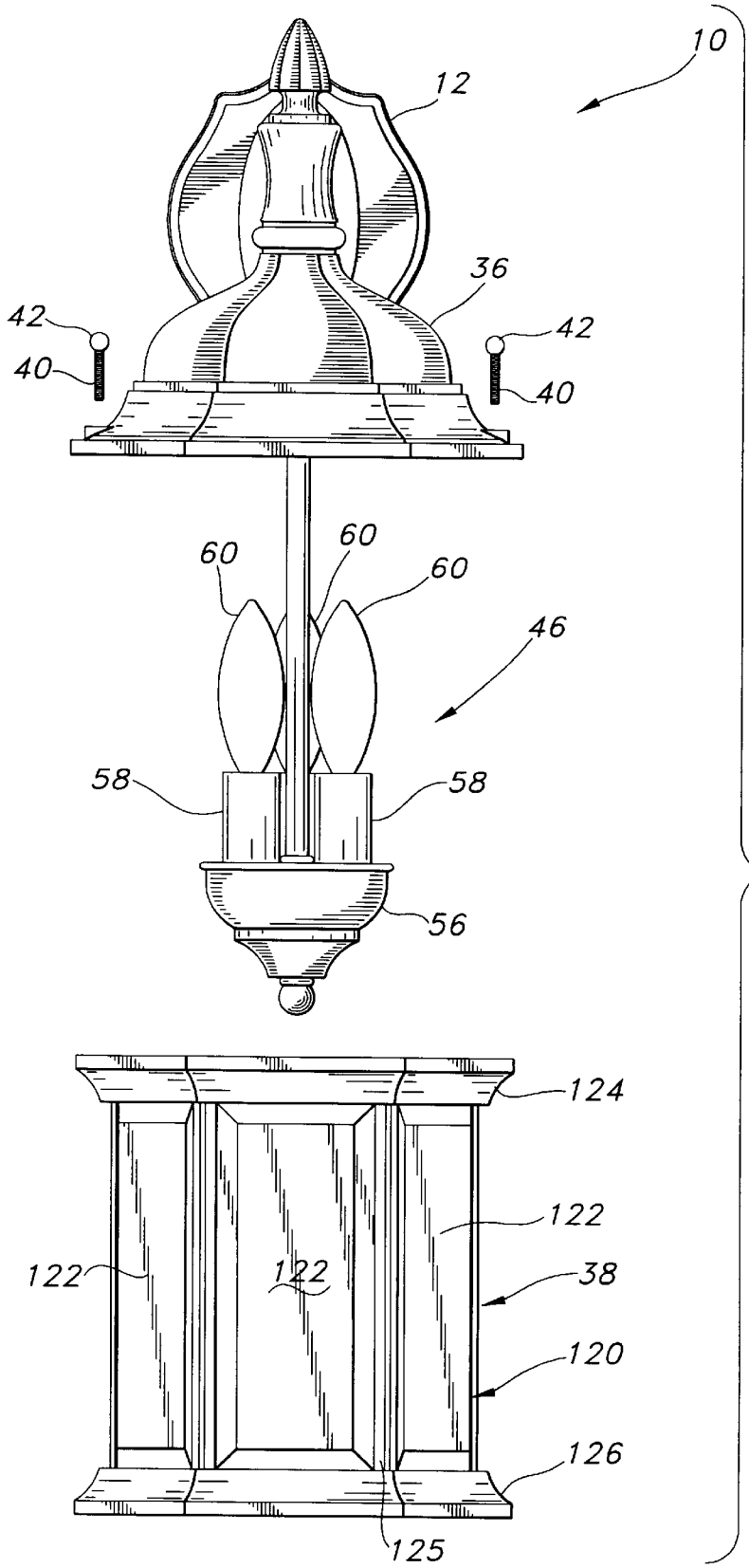
FIG. 2 is an exploded assembly view of the lantern shown in FIG. 1.
Figure 3:
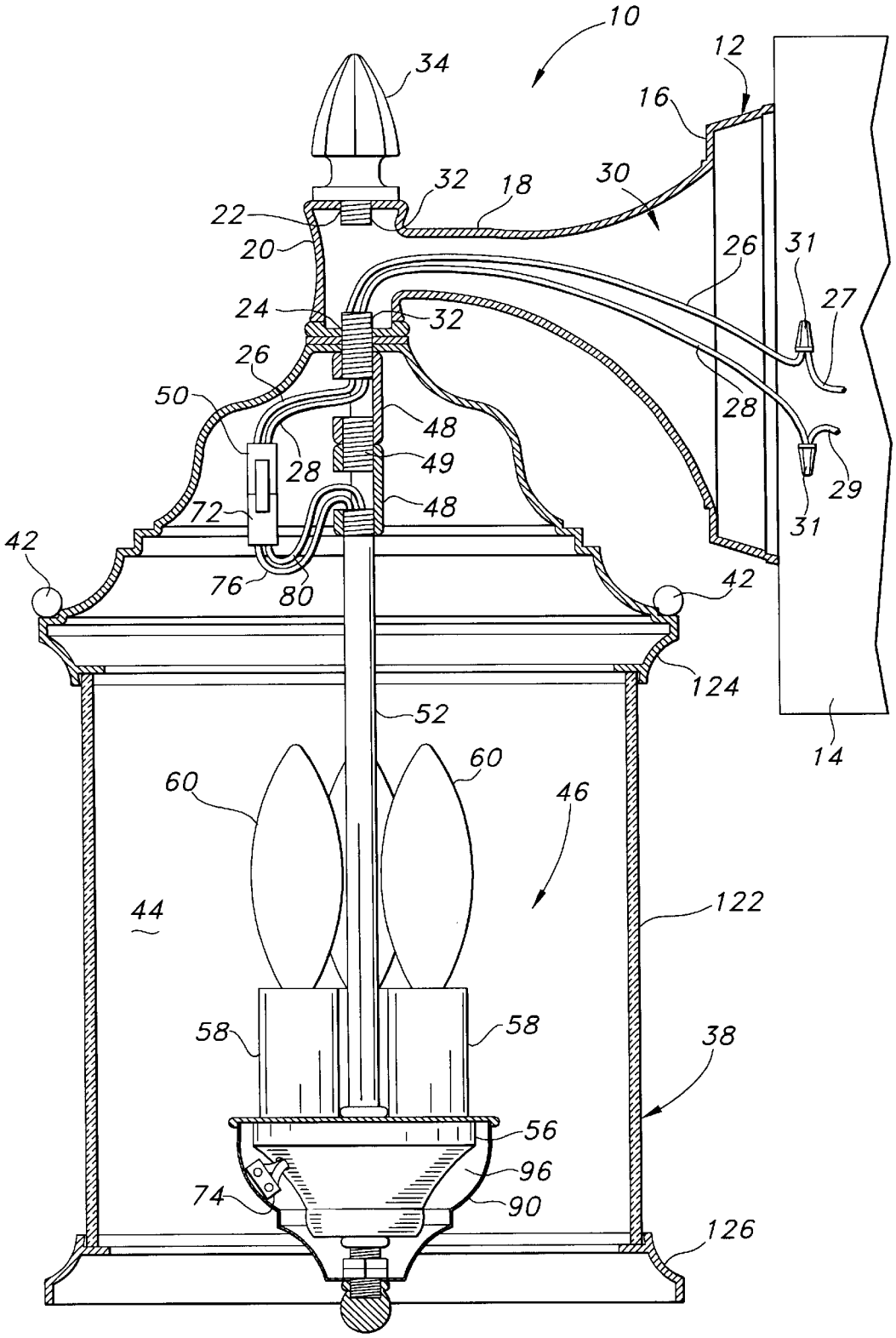
FIG. 3 is a view, partially in cross-section, taken generally along line 3—3 in FIG. 1.

Referring now to the drawings, wherein like reference numerals have been used for similar elements throughout, FIGS. 1–3 illustrate a convertible modular lantern 10 according to a first embodiment of the present invention. Lantern 10 can be classified as a "high outlet" lantern as discussed previously in this application and subsequently discussed in further detail. Lantern 10 includes a mount assembly 12 which may be used to mount lantern 10 to an electrical junction box 14 of a residential or commercial structure (not shown). It should be understood that the electrical junction box may be mounted flush with a wall (not shown) of the residential or commercial structure, or may be recessed from the wall. It should be further understood that the lantern 10, as well as the remaining lanterns of the present invention, may alternatively be mounted directly to the wall of the residential or commercial structure, for instance in the case of older structures which do not include an electrical junction box. Assembly 12 includes a hollow backplate 16 and conventional mount means (not shown) disposed within the backplate 16 for attaching mount assembly 12 to junction box 14. The conventional mount means may include one or more brackets which are connected to backplate 16 and are effective for receiving conventional fasteners (not shown) used to attach mount assembly 12 to junction box 14. Assembly 12 further includes a hollow arm 18 which is connected to and protrudes from the backplate 16. Preferably, backplate 16 and arm 18 are made as a one piece construction and may be cast as one piece, preferably of cast aluminum. Alternatively, backplate 16 and arm 18 may be made as separate pieces and attached to one another in a conventional manner. Also, alternate materials of construction for backplate 16 and arm 18 include brass, steel and plastic including various poly resins. Arm 18 terminates in a distal end portion 20 which includes upper 22 and lower 24 openings. Backplate 16 and arm 18 are hollow to permit electrical wires 26 and 28, which are coupled to each of the lamp sockets included in lantern 10 as subsequently discussed, to be routed through a hollow interior 30 of assembly 12 and electrically coupled to wires 27 and 29 of the structure, as shown in FIG. 3. Accordingly, wires 26 and 28 are electrically coupled to the source of 120 vac electrical power, available within the residential or commercial structure, thereby permitting the subsequently discussed light bulbs of the lantern of the present invention to be illuminated. It should be further understood, that appropriate switch means (not shown) may be available within the structure to turn the 120 vac electrical power on and off to lantern 10, as desired. A pair of threaded nipples 32 are inserted in the openings 22 and 24 of the distal end portion 20 of arm 18. A decorative finial 34 is threaded to the upper one of nipples 32.

Lantern 10 further includes a top housing 36 and a shade assembly 38. In one preferred embodiment, both the mount assembly 12 and the upper housing 36 are constructed of aluminum. Alternatively, mount assembly 12 and upper housing 36 may be constructed of brass, steel, ceramic or plastic including various poly resins. The materials of construction of shade assembly 38 will be discussed subsequently. Top housing 36 is attached to shade assembly 38 by fasteners 40 which may comprise a threaded screw having a decorative upper portion 42 in the shape of a ball. Each fastener 40 may engage a female threaded boss included in the shade assembly 38 as subsequently discussed in further detail. Top housing 36 and shade assembly 38 combine to form an interior cavity 44 of lantern 10. As shown in FIGS. 1–3, the top housing 36 is generally bell-shaped which is ornamental and decorative in appearance. However, housing 36 may have other ornamental and decorative shapes.

Lantern 10 further includes a downrod and light cluster assembly 46 which is further illustrated in FIGS. 4–8 and comprises an important feature of the present invention. As shown in FIGS. 1 and 3, the downrod and light cluster assembly 46 is disposed within the interior cavity 44 of lantern 10. As shown in FIG. 3, an open coupling 48 is threaded to the threaded nipple 32 which extends through the lower opening 24 in the distal end portion 20 of arm 18 of the mounting assembly 12. Electrical wires 26 and 28 terminate at one end in a male, keyed electrical block connector 50. Wires 26 and 28 extend away from connector 50 and are routed through a side opening in coupling 48, through the hollow interior of nipple 32, and through the hollow interior 30 of mount assembly 12. Connector 50 is electrically connected to the downrod and light cluster assembly 46 as subsequently described.

The downrod and light cluster assembly 46 includes a hollow downrod 52 which is threaded at an upper end thereof to a second open coupling 48. The first and second couplings 48 are interconnected by a threaded nipple 49, thereby providing support for the downrod and light cluster assembly 46. The assembly 46 further includes a hollow inner cup 56 and a plurality of lamp sockets 58 which are mounted on a support member 54 which is attached to the inner cup 56. In the illustrative embodiment, support member 54 is a plate. The construction and features of each lamp socket 58 is conventional in nature and therefore known in the art. An interior portion of one of the lamp sockets 58 is illustrated in the cut-away view portion of FIG. 4. In the illustrative embodiment, assembly 46 includes three of the lamp sockets 58, with each being configured to accept a candelabra based light bulb 60. Alternatively, one, two, or more than three of the lamp sockets 58 may be included in assembly 46, with each accepting one of the candelabra based light bulbs 60. As yet a further alternative, the inner cup 56 may support one or more light sockets which are configured to accept a medium based light bulb in each socket. Downrod 52 is attached at a lower end thereof to the support member 54, thereby providing support for the inner cup 56. Downrod 52 includes a threaded lower end which is threaded into an open coupling 48 which may abut a washer 55.

Figure 9:
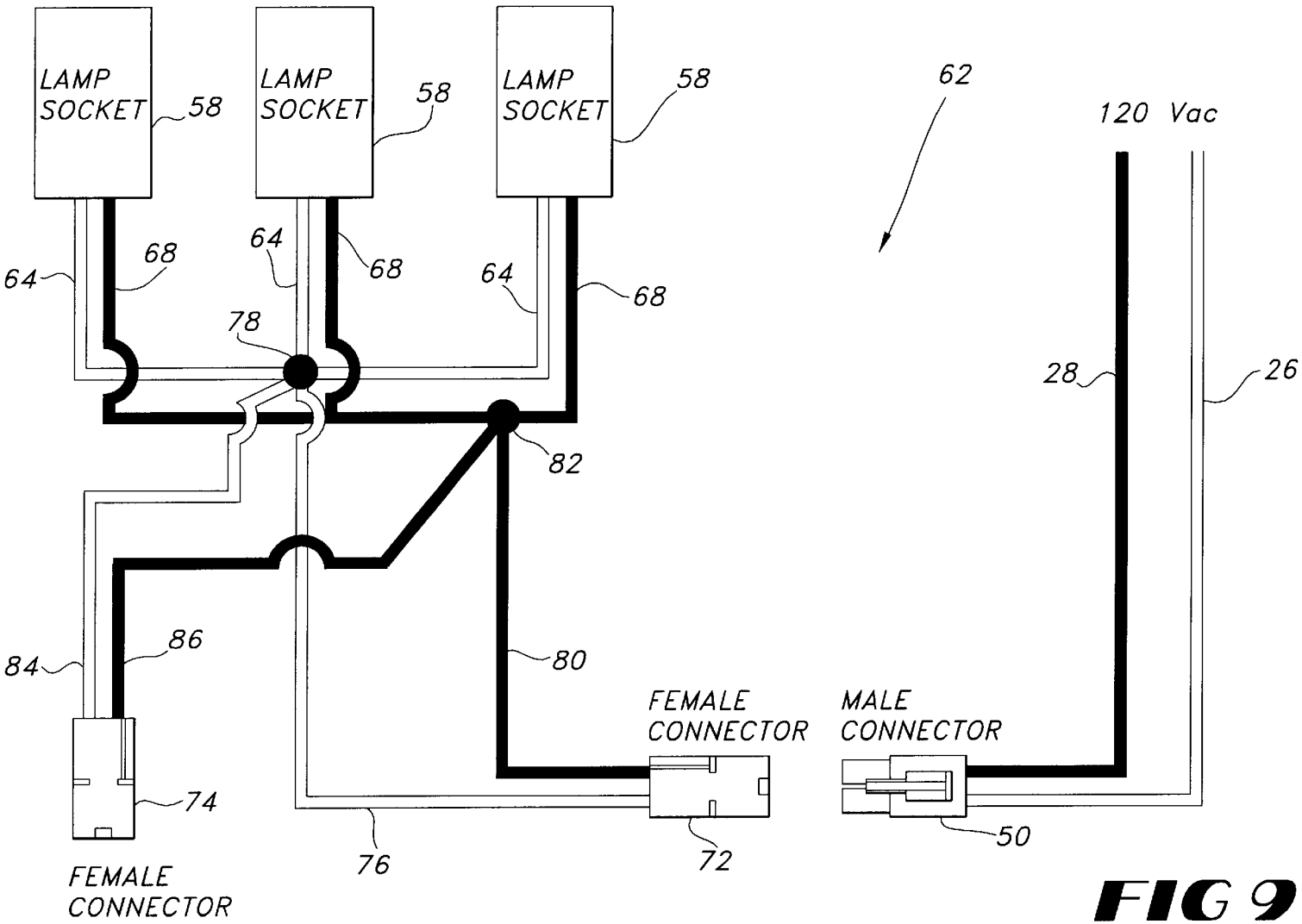
FIG. 9 is a wiring schematic of the lantern shown in FIGS. 1–8.

The electrical circuitry for providing electrical power to bulbs 60 indicated generally at 62, is illustrated in FIG. 9. The circuitry includes a plurality of neutral wires 64, with each one connected at one end to one of the lamp sockets 58. Each of the wires 64 are connected at an opposite end thereof to a common neutral wire 76. The circuitry further includes a plurality of hot leads or wires 68 which are connected at one end to each of the lamp sockets 58 and at an opposite end to a common hot lead or wire 80. The circuitry further includes a first, or upper, female, keyed, electrical block connector 72 and a second, or lower, female, keyed, electrical block connector 74. In lantern 10, connector 72 is electrically coupled to each of the sockets 58 as follows. The neutral wire 76 is attached at one end to connector 72 and at an opposite end to each of the neutral wires 64 at node 78. A hot lead or wire 80 is attached at one end to connector 72 and at the opposite end to each of the hot leads or wires 68 at node 82. The lower block connector 74 is similarly electrically coupled to each of the lamp sockets 58. More particularly, a neutral wire 84 is attached at one end to connector 74 and at the opposite end to each of the neutral wires 64 at node 78. A hot lead or wire 86 is attached at one end to connector 74 and at the other end to each of the hot leads or wires 68 at node 82.

In each illustrative embodiment of the convertible modular lantern of the present invention the connectors 72 and 74 of the downrod and light cluster assembly 46 comprise female, keyed electrical block connectors, with one of the connectors 72 and 74 mating with connector 50 which comprises a male, keyed electrical block connector. However, it should be understood that alternatively, connectors 72 and 74 may comprise male, keyed electrical block connectors. In this instance, connector 50 comprises a mating female, keyed electrical block connector. Keyed electrical block connectors are preferred due to safety considerations. For instance, the use of keyed electrical block connectors prevents two connectors (such as connectors 50 and 72, or 50 and 74) from being electrically connected with an improper, reversed polarity. This prevents an electrical short circuit and the associated potential overheating.

In one preferred embodiment each of the connectors 50, 72 and 74 is a standard nylon, keyed block connector having a two-pin configuration. Each of the connectors 50, 72 and 74 accepts an 18 AWG wire for each of the two pins and is rated 120 vac, 2A. In one preferred embodiment, each of the connectors measures about 0.59 inches (15 mm) wide by about 1.2 inches (30 mm) long by about 0.31 inches (8 mm) thick. Alternate connectors may be used provided they are the equivalent of connectors 50, 72 and 74 with respect to functionality and safety features, and are sized to fit within cavity 96.

As discussed previously, a source of 120 vac electrical power, available within the residential or commercial structure, is provided to the electrical junction box 14 via wires 27 and 29 and then to the connector 50 via wires 26 and 28. Wire 26 may be electrically connected to the wire 27 via a conventional wire connector 31, as is well known in the art. Similarly, wire 28 may be electrically connected to wire 29 by another of the conventional wire connectors 31. The electrical circuitry is completed for lantern 10 by electrically connecting the connector 50 to the connector 72 In this manner, electrical power is provided to each of the lamp sockets 58 thereby illuminating the bulbs 60.

The presence of connectors 50, 72 and 74 is an important feature of the present invention. As discussed previously, and as shown in FIGS. 1–3, lantern 10 is a high outlet configuration lantern. However, the presence of connectors 50, 72 and 74, allows an end user to convert lantern 10 to a standard or low outlet configuration, by connecting connector 50 to the lower connector 74, instead of the upper connector 72, as illustrated and discussed subsequently with respect to the low outlet configuration lanterns of the present invention. This provides a significant advantage over conventional lanterns, which are not modular and have the electrical power "hard wired" directly from the electrical junction box, or from another location within a structure, to the lamp sockets.

Figure 4:
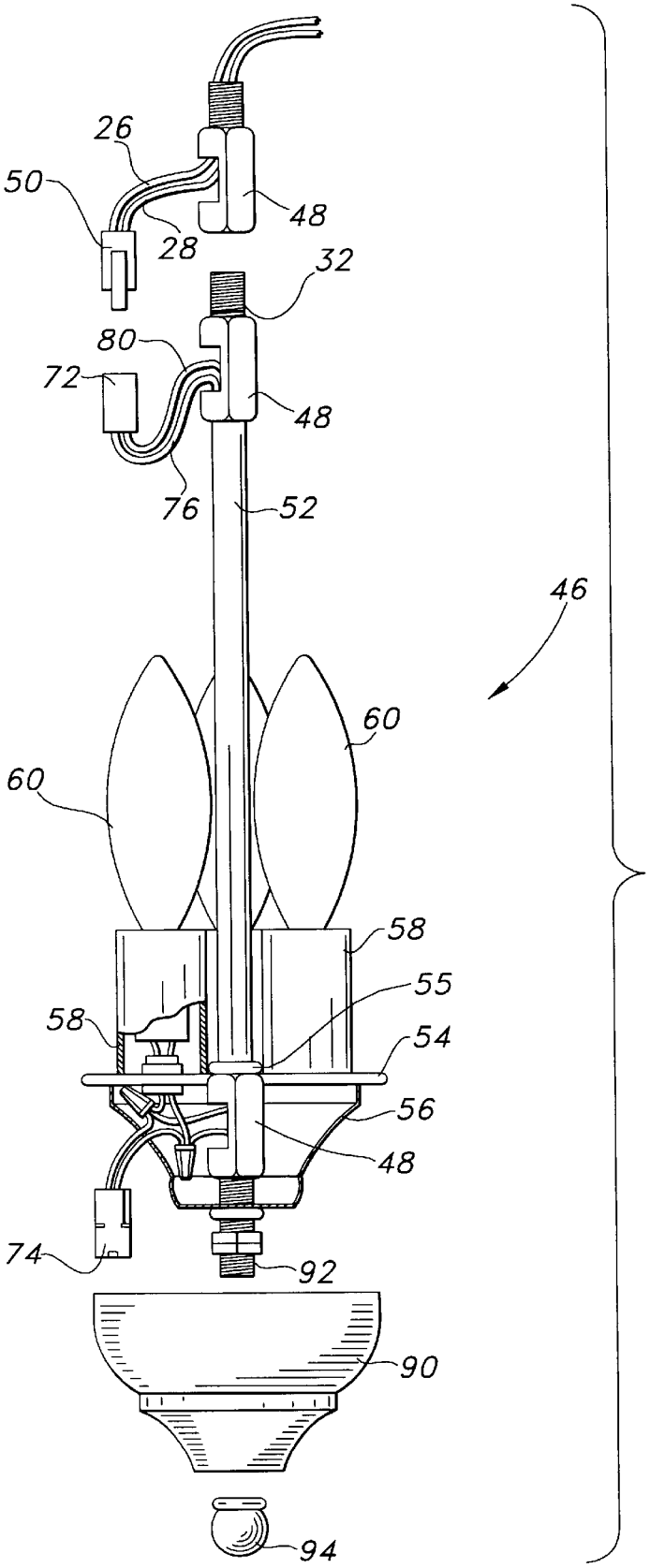
FIG. 4 is an exploded assembly view, partially in cutaway view and partially in cross-sectional view, of the downrod and light cluster assembly included in the lantern shown in FIGS. 1–3.
Figure 5:
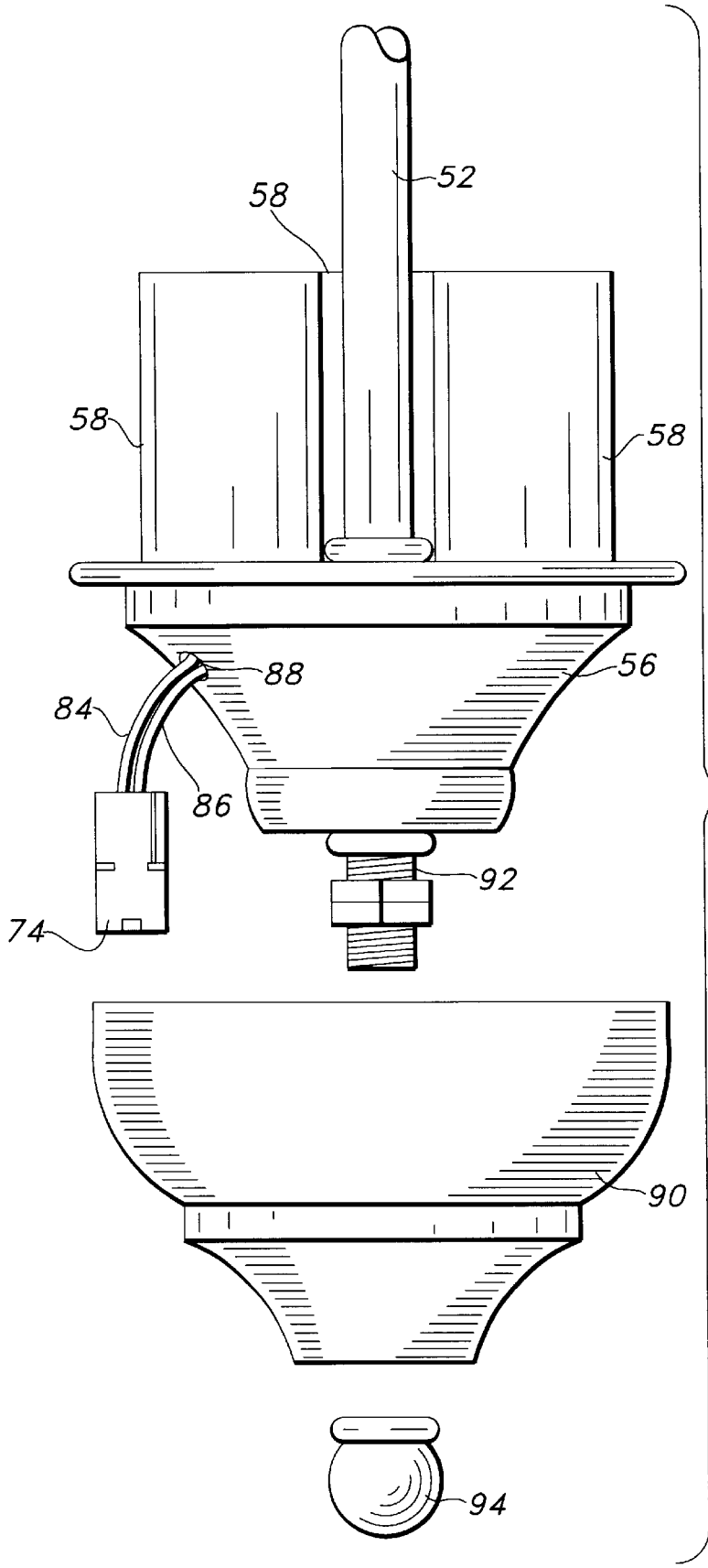
FIG. 5 is an enlarged, fragmentary, exploded assembly view of the downrod and light cluster assembly shown in FIG. 4.
Figure 6:
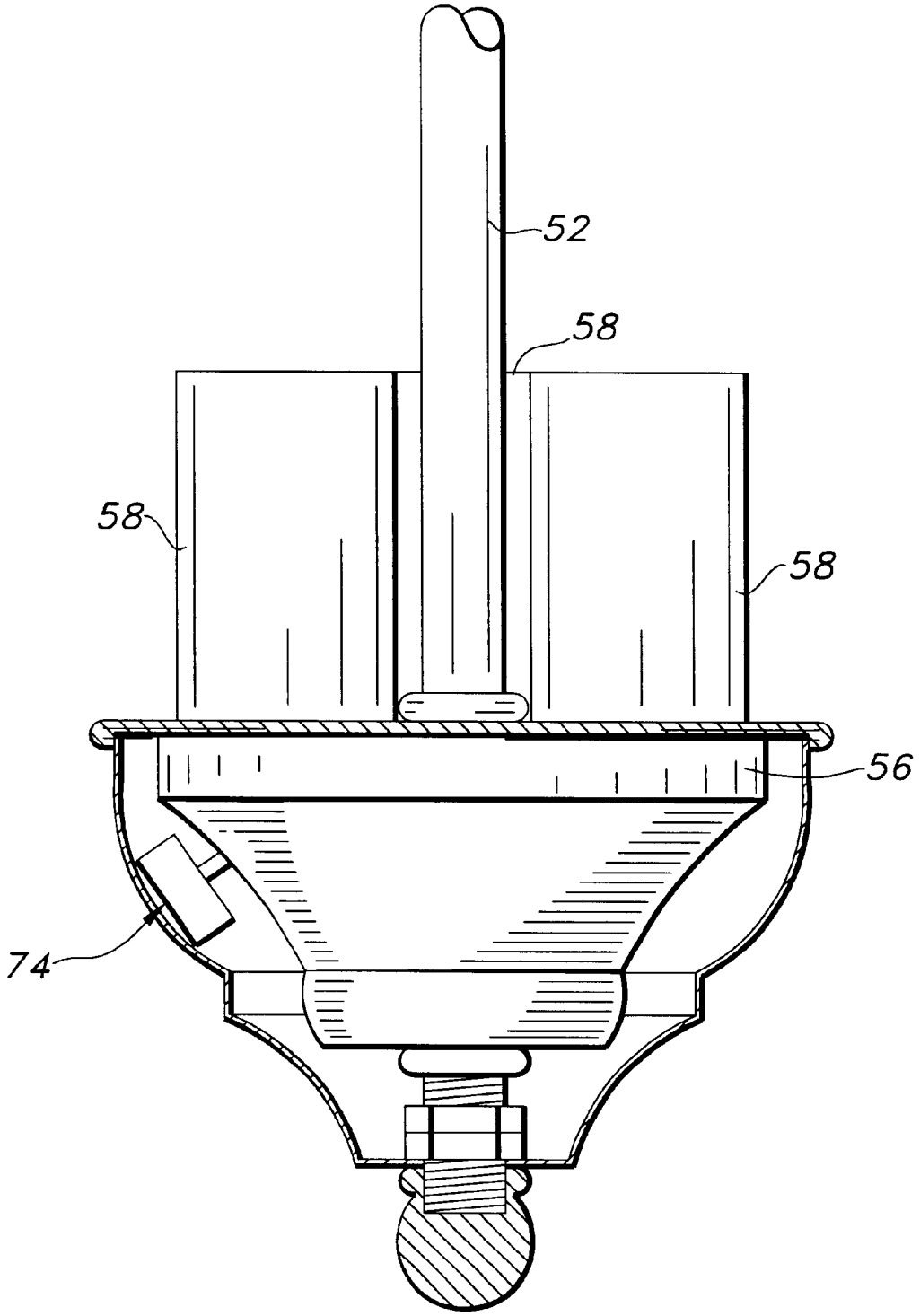
FIG. 6 is an enlarged, fragmentary view of the downrod and light cluster assembly shown in FIG. 4, with the lower portion of the assembly shown in an assembled condition.

As shown in FIG. 4, wires 76 and 80 extend upward through the hollow interior of downrod 52, as well as the couplings 48 attached to the lower and upper ends of downrod 52, and are routed out through a notch or opening in the upper coupling 48. Wires 76 and 80 are then attached to the upper connector 72 as discussed previously. Wires 84 and 86 are routed downward through the hollow interior of inner cup 56 and then exterior of cup 56 through an aperture or opening 88 formed in cup 56. Wires 84 and 86 are then attached to the lower block connector 74 as discussed previously.

The downrod and light cluster assembly 46 of lantern 10 further includes a hollow outer cup 90 which is disposed in surrounding relationship with the inner cup 56 as best seen in FIG. 3. The outer cup 90 is attached to a lower end of the inner cup 56 via a threaded nipple 92 and decorative ball 94 as follows. An upper end of nipple 92 is threaded to the inner cup 56 and a lower end of nipple 92 passes through an opening in the lower surface of outer cup 90. The decorative ball 94 is then threaded onto the lower end of nipple 92, thereby securing outer cup 90 in position. The decorative ball 94 may be optionally replaced with a decorative finial. As shown in FIG. 3, the inner cup 56 and outer cup 90 are sized and shaped to allow the lower block connector 74 to be disposed within a cavity 96 defined by and extending between inner cup 56 and outer cup 90.

Figure 7:
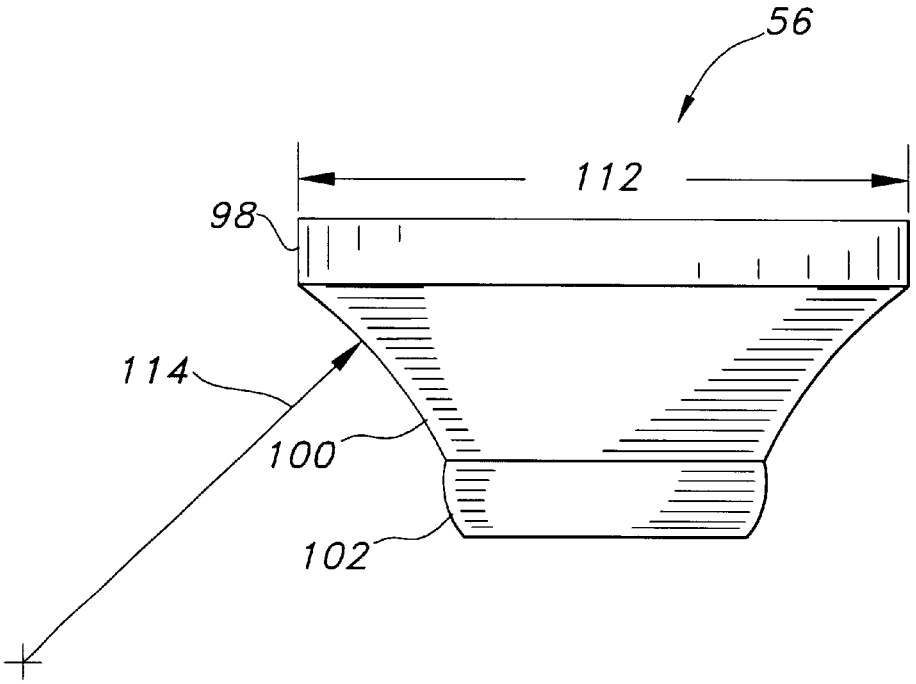
FIG. 7 is an enlarged, elevational view of an inner cup included in the downrod and light cluster assembly shown in FIGS. 4–6.
Figure 8:
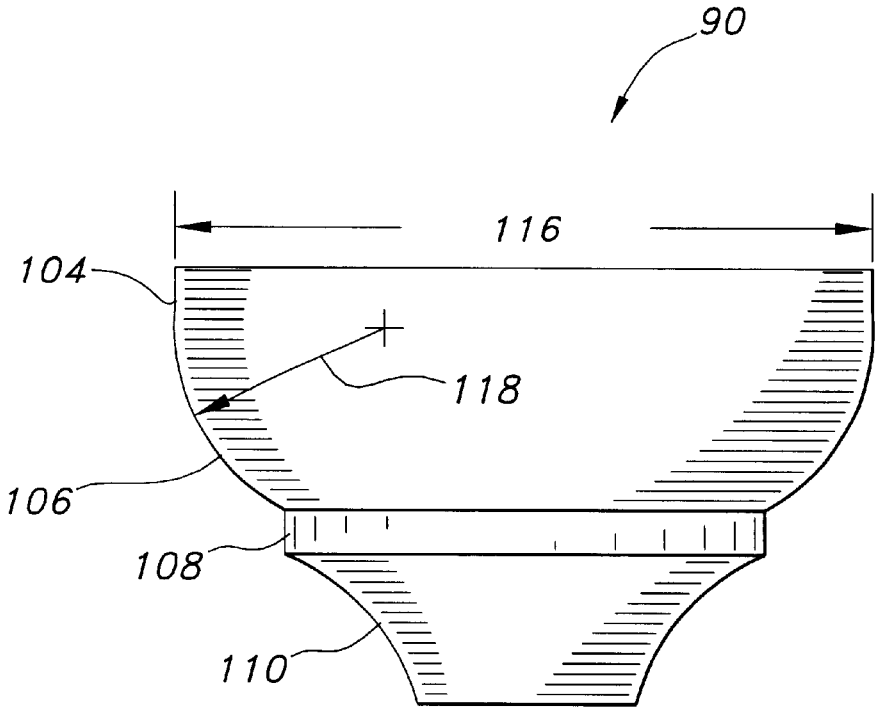
FIG. 8 is an enlarged, elevational view of an outer cup included in the downrod and light cluster assembly shown in FIGS. 4–6.

The shape and features of inner cup 56 and outer cup 90 are further illustrated in FIGS. 7 and 8, respectively, for the illustrative embodiment of lantern 10. It should be understood that inner cup 56 and outer cup 90 may have other shapes and configurations, provided that the cavity 96 formed between cups 56 and 90 is of a sufficient size to accommodate block connector 74 and further provided that the size and configuration of cups 56 and 90 are compatible with the remaining features of the downrod and light cluster assembly 46 and the shade assembly 38 of lantern 10. The inner cup 56 includes an upper, cylindrical portion 98, an intermediate, toroidally-shaped portion 100 which is attached at an upper end to the cylindrical portion 98, and a lower ring portion 102 which is attached to a lower end of portion 100. The outer cup 90 includes a bowl-shaped upper portion 104 having a convex outer surface 106, an intermediate cylindrical portion 108 which is attached to a lower end of upper portion 104 and a toroidally-shaped lower portion 110 which is attached to the cylindrical portion 108.

In the illustrative embodiment, the upper, generally cylindrical portion 98 of the inner cup 56 includes an outside diameter 112 of about 2.8 inches (71.6 mm) and the toroidally-shaped portion 100 includes a radius of curvature 114 having a magnitude of about 1.9 inches (48.6 mm). Also in the illustrative embodiment, the upper portion 104 of the outer cup 90 includes an upper, maximum diameter 116 having a magnitude of about 3.2 inches (81.3 mm). The outer surface 106 of the upper portion 104 is formed with a radius of curvature 118 having a magnitude of about 1.6 inches (40.6 mm). The foregoing values of diameters 112 and 116, as well as radii 114 and 118 combine to create sufficient space within cavity 96 to accept the keyed block connector 74. Furthermore, it should be understood that the values of these diameters and radii may vary somewhat while still providing ample space for block connector 74. Additionally, it should be further understood that the foregoing values of these diameters and radii are provided by way of illustration, and not of limitation since other shapes and configurations of inner cup 56 and outer cup 90 are considered to be within the scope of the present invention, as discussed previously.

In the illustrative embodiment shade assembly 38 has a substantially hexagonal cross-sectional shape. Alternatively, shade assembly 38 may have other polygonal cross-sectional shapes or may have a substantially circular cross-sectional shape. The shade assembly 38 includes a frame, indicated generally at 120 and a plurality light-transmitting panels 122 which are retained and positioned by frame 120 as subsequently discussed in further detail. Frame 120 is preferably made of aluminum but may alternatively be made of other materials including brass, steel, ceramic or plastic including various poly resins. The material of construction of frame 120 preferably matches that of mount assembly 12 and upper housing 36. In one preferred embodiment, each of the light-transmitting panels 122 are made of beveled glass. However, panels 122 may alternatively be made of plain glass, i.e., without beveled edges, or of plastic. The panels 122 are either transparent or translucent so as to permit the light emitting from bulbs 60 to be transmitted exterior of lantern 10.

Figure 10:
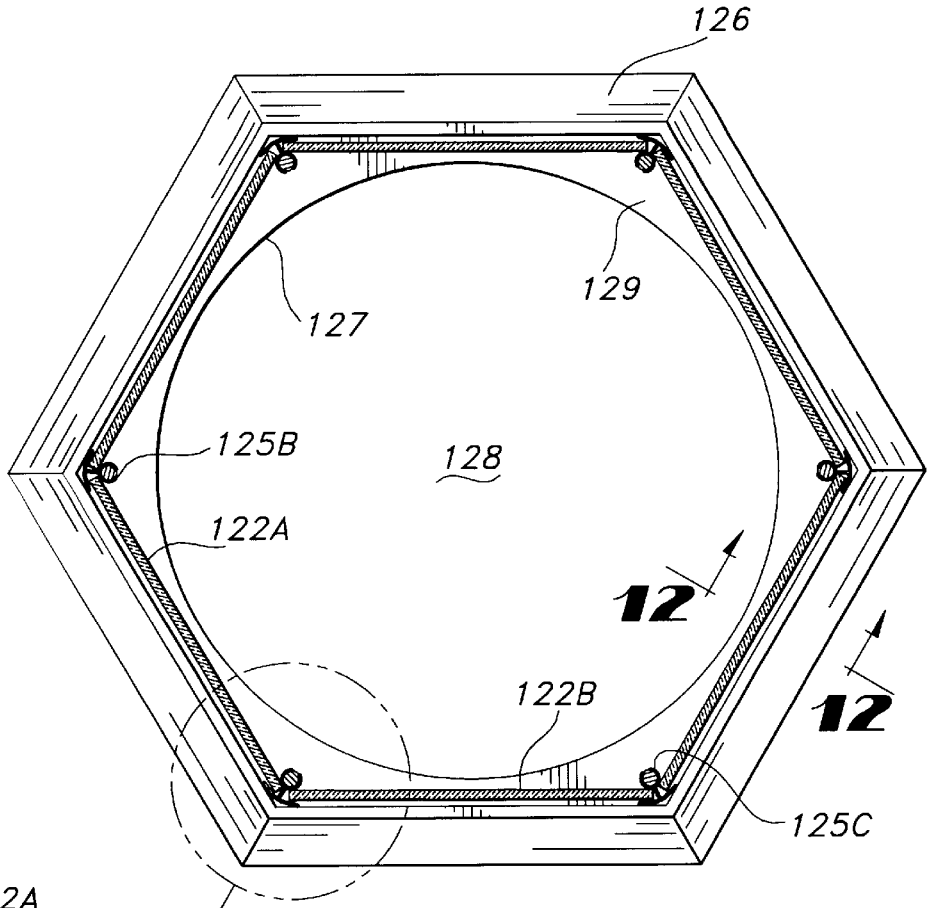
FIG. 10 is a cross-sectional view taken along line 10—10 in FIG. 1 with the downrod and light cluster assembly omitted for purposes of clarity of illustration.
Figure 11:
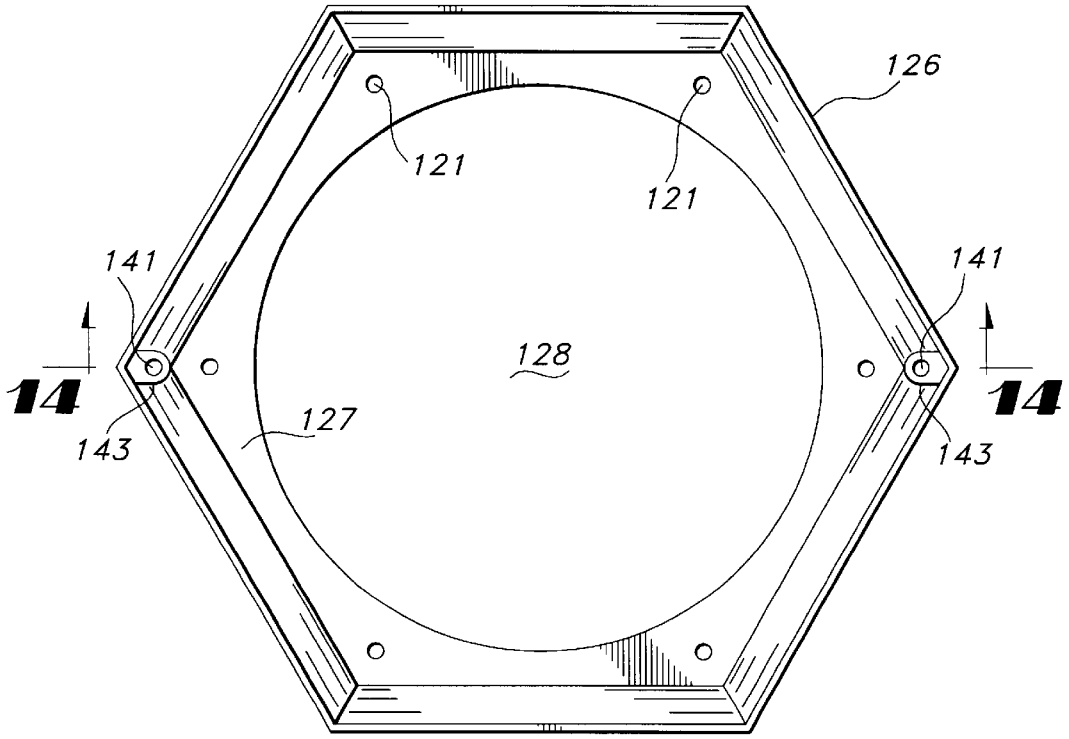
FIG. 11 is a bottom plan view taken along line 11—11 in FIG. 1 with the downrod and light cluster assembly omitted for purposes of clarity of illustration.
Figure 17:
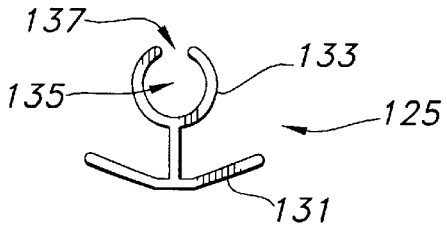
FIG. 17 is an end view of the member shown in FIGS. 15 and 16.
Figure 15:
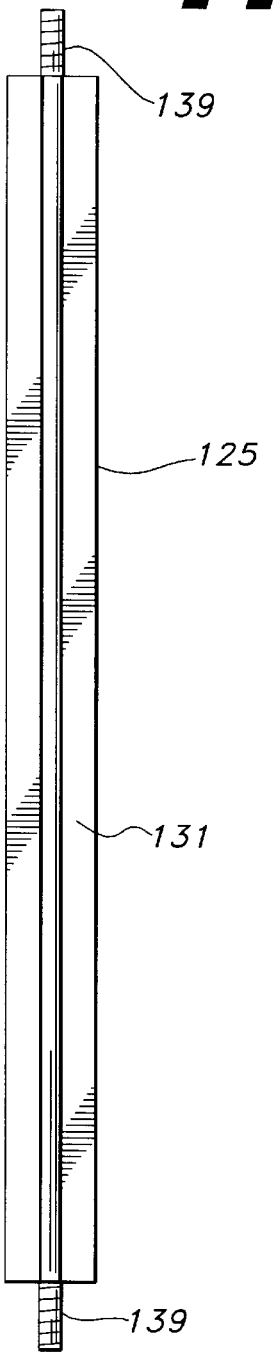
FIG. 15 is a view, taken from a position exterior of the lantern shown in FIG. 1, of a portion of the shade assembly, in a disassembled condition.
Figure 16:
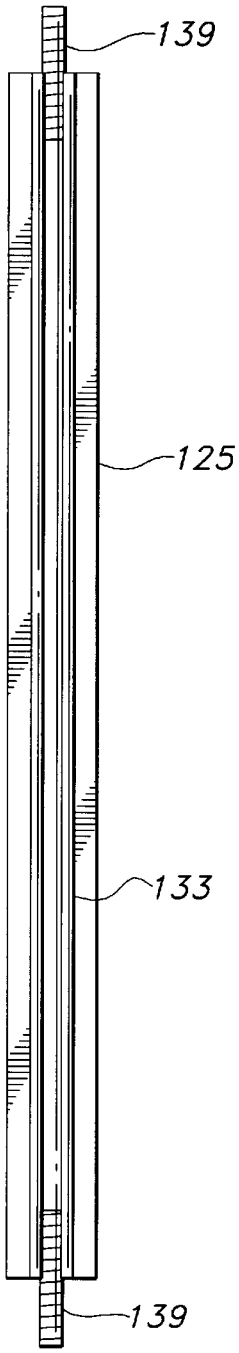
FIG. 16 is a view similar to FIG. 15 but taken from a position on the interior of the lantern shade assembly looking outward.

The frame 120 of shade assembly 38 includes an upper flange 124 which mates with the top housing 36 of lantern 10 Housing 36 is fastened to flange 124 via fasteners 40 which are threaded into bosses (not shown) included in flange 124 Frame 120 further includes a lower flange 126 and a plurality of substantially vertically extending members 125 that interconnect and are attached to the upper flange 124 and the lower flange 126 as shown in FIGS. 1 and 2 and further illustrated in FIGS. 10–17. FIG. 10 is a plan view in which the downrod and light cluster assembly 46 has been omitted for purposes of clarity, which further illustrates flange 126 and FIG. 11 is a bottom plan view of flange 126. FIGS. 15 and 16 illustrate members 125 in a disassembled condition relative to the flanges 124 and 126 As shown in FIGS. 10 and 11, flange 126 includes a plurality of holes 121 extending therethrough and flange 124 includes a similar plurality of holes (not shown). As best seen in the cross-sectional view illustrated in FIG. 17, each member 125 includes a tee-shaped portion 131 and a hollow tubular portion 133 attached to portion 131. The tubular portion 133 defines an interior cavity 135 and portion 133 includes a longitudinally extending slot 137. Threaded rods 139 are inserted into the upper and lower end of the cavity 135 of each member 125 as illustrated in FIGS. 15 and 16. The rods 139 inserted into the lower end of each cavity 135 pass through the holes 121 in flange 126 and are retained by conventional nuts (not shown).

Similarly, the rods 139 which are inserted in the upper end of each cavity 135 pass through holes in upper flange 124 (not shown) and are retained by conventional nuts (not shown).

Figure 12:
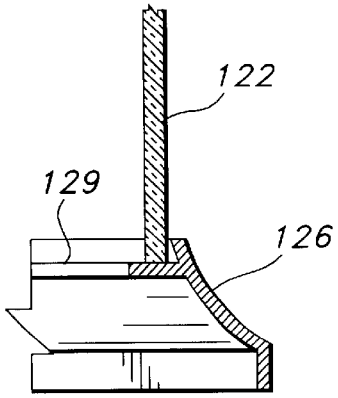
FIG. 12 is a cross-sectional view taken along line 12—12 in FIG. 10.
Figure 14:
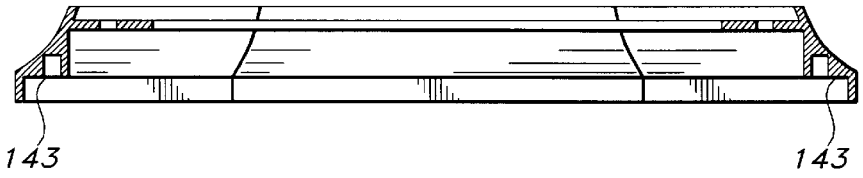
FIG. 14 is a cross-sectional view taken along line 14—14 in FIG. 11.

As shown in FIGS. 10 and 11, lantern 10 has an open bottom configuration. More particularly, as shown in FIGS. 10 and 11, the lower flange 126 has an inner shelf portion 127 with a central, substantially circular opening 128 formed therein, thereby creating the open bottom of lantern 10 The bottom edge of each of the light-transmitting panels 122 rests on an upper surface 129 of shelf portion 127 as shown in FIG. 12, thereby retaining the panels 122 in the desired vertical position and preventing panels 122 from falling downward, out of lantern 10.

Figure 13:
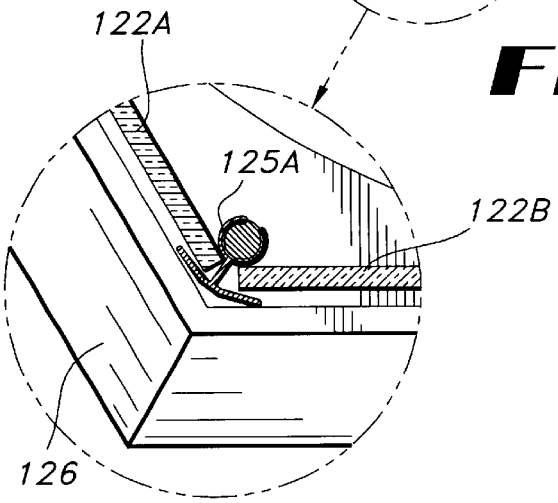
FIG. 13 is an enlarged, fragmentary view of a portion of the view shown in FIG. 10.

The light-transmitting panels 122 are disposed between and further retained in position by adjacent ones of members 125 as best seen in the enlarged, fragmentary view shown in FIG. 13. Each lateral end of each panel 122 is sandwiched between the tee-shaped portion 131 and the tubular portion 133 of one of the members 125 as shown in FIG. 13. Each of the members 125 such as member 125A, retains a lateral end of two adjacent panels 122, such as panels 122A and 122B as shown in FIG. 13. The opposite lateral end of panel 122A is retained by member 125B while the opposite lateral end of panel 122B is retained by member 125C. A similar retention scheme is used for each of the panels 122.

Figure 18:
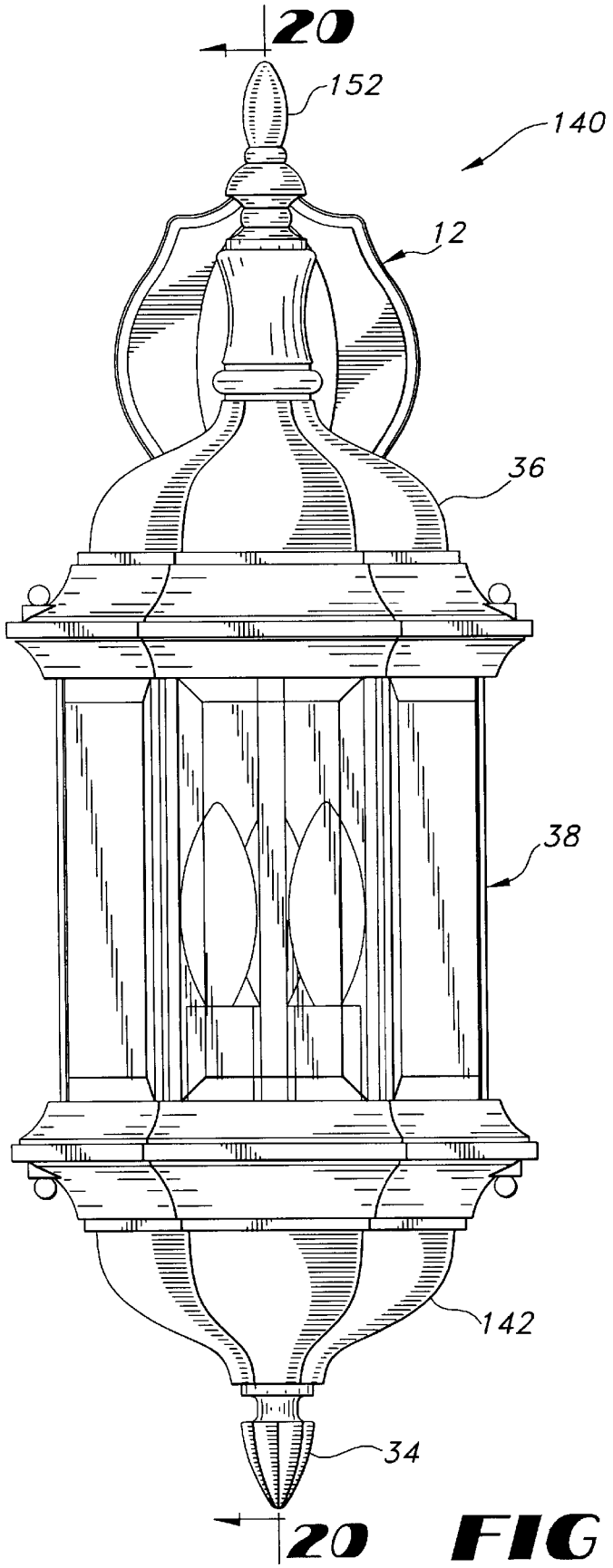
FIG. 18 is a front elevational view illustrating a convertible modular lantern according to a second embodiment of the present invention.
Figure 19:
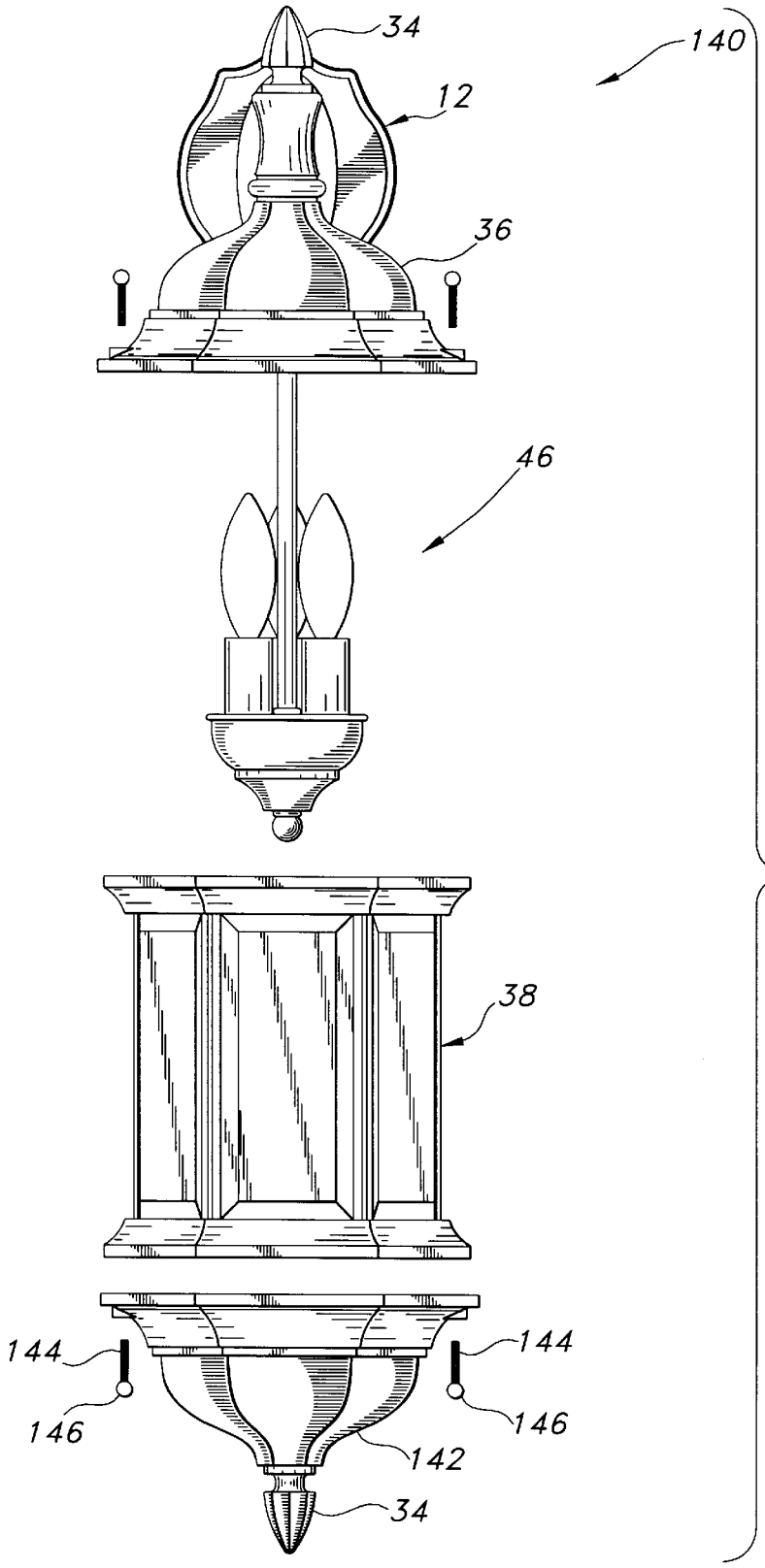
FIG. 19 is an exploded assembly view of the lantern shown in FIG. 18.
Figure 20:
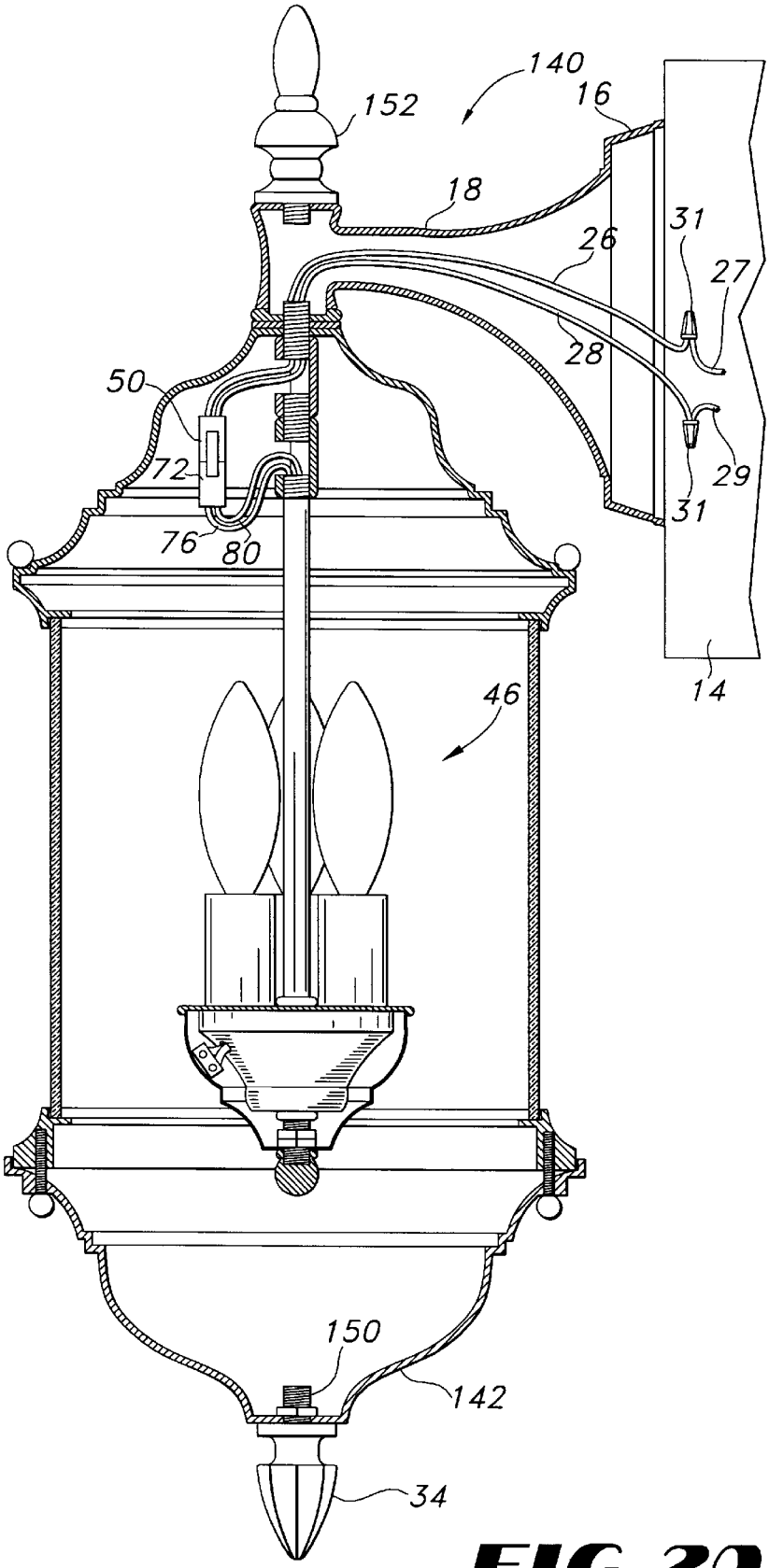
FIG. 20 is a view, partially in cross-section, taken generally along line 20—20 in FIG. 18.

FIGS. 18–20 illustrate a convertible modular lantern 140 according to a second embodiment of the present invention. Like lantern 10, lantern 140 may be classified as a "high outlet" configuration lantern. Lantern 140 is the same as lantern 10 except as subsequently discussed. In the illustrative embodiment, lantern 140 includes all of the same components as lantern 10, which were illustrated and described previously, and additionally includes a lower or bottom housing 142 which is attached to the lower flange 126 of the shade assembly 38 via a plurality of fasteners such as threaded screws 144 which may include a decorative ball-shaped head 146. Each of the fasteners 144 is threaded into a threaded hole 141 of a boss 143 formed in flange 126 The bottom housing 142 is hollow but closed, so that lantern 140 has a closed bottom configuration, unlike lantern 10, thereby providing an entirely different look or appearance than lantern 10. A decorative finial 34 is attached to the lower portion of the lower housing 142 via a threaded nipple 150. The shape of finial 34 is such that it is referred to in the art as an "acorn" finial. FIG. 19 illustrates another acorn finial 34, which is threaded to arm 18, the same as lantern 10 However, for purposes of illustrating a possible alternative, FIGS. 18 and 20 illustrate lantern 140 with an elongated finial 152 attached to arm 18 which has a different shape than finial 34. As shown in FIGS. 18–20, the shape of the lower housing 142 may be substantially the same as, or identical to, the shape of upper housing 36. Alternatively, the lower housing 142 may have a somewhat different shape or configuration than housing 36 to provide a different appearance for lantern 140.

Figure 21:
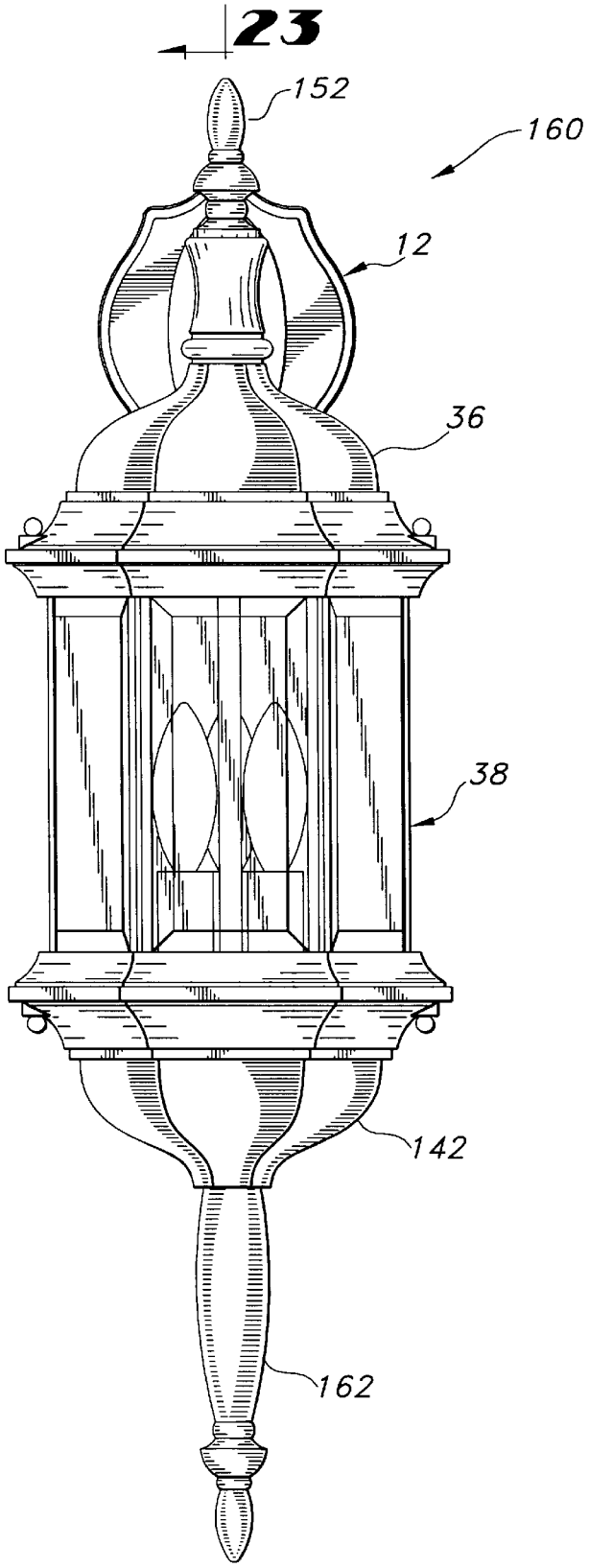
FIG. 21 is a front elevational view of a convertible modular lantern according to a third embodiment of the present invention.
Figure 22:
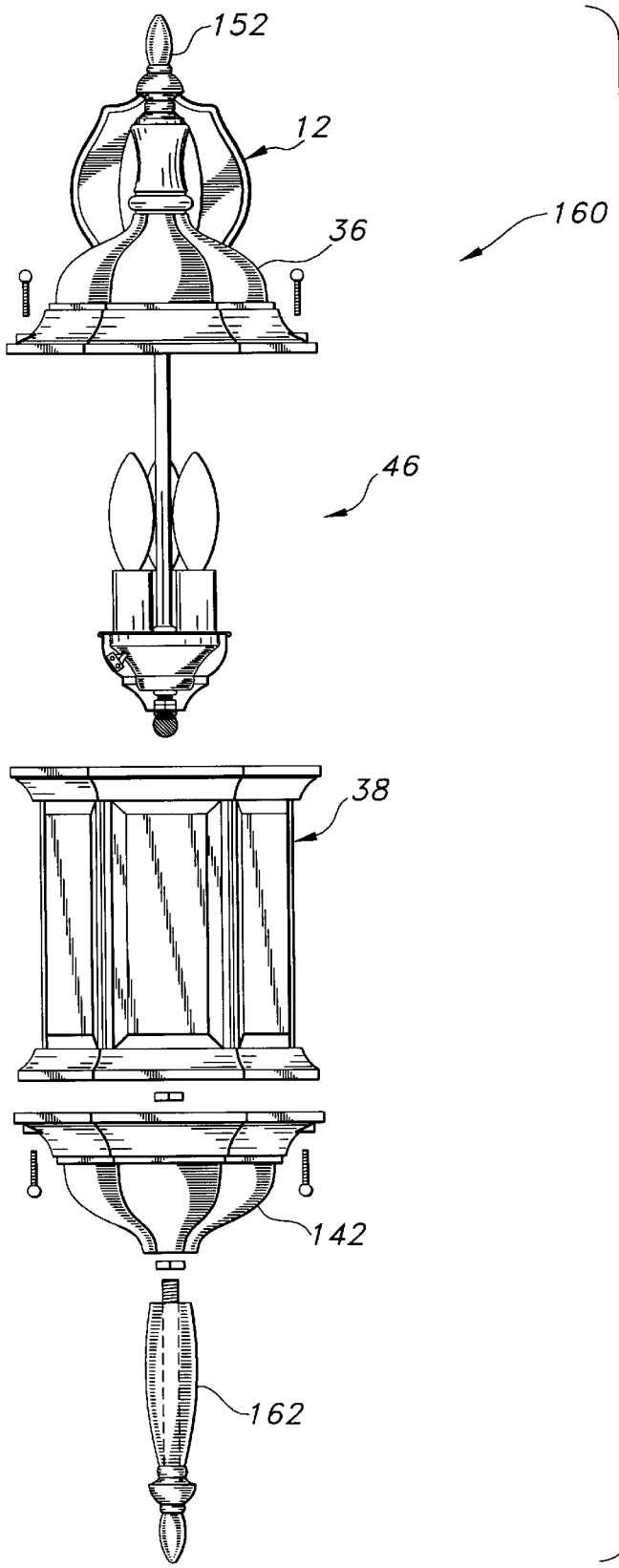
FIG. 22 is an exploded assembly view of the lantern shown in FIG. 21.
Figure 23:
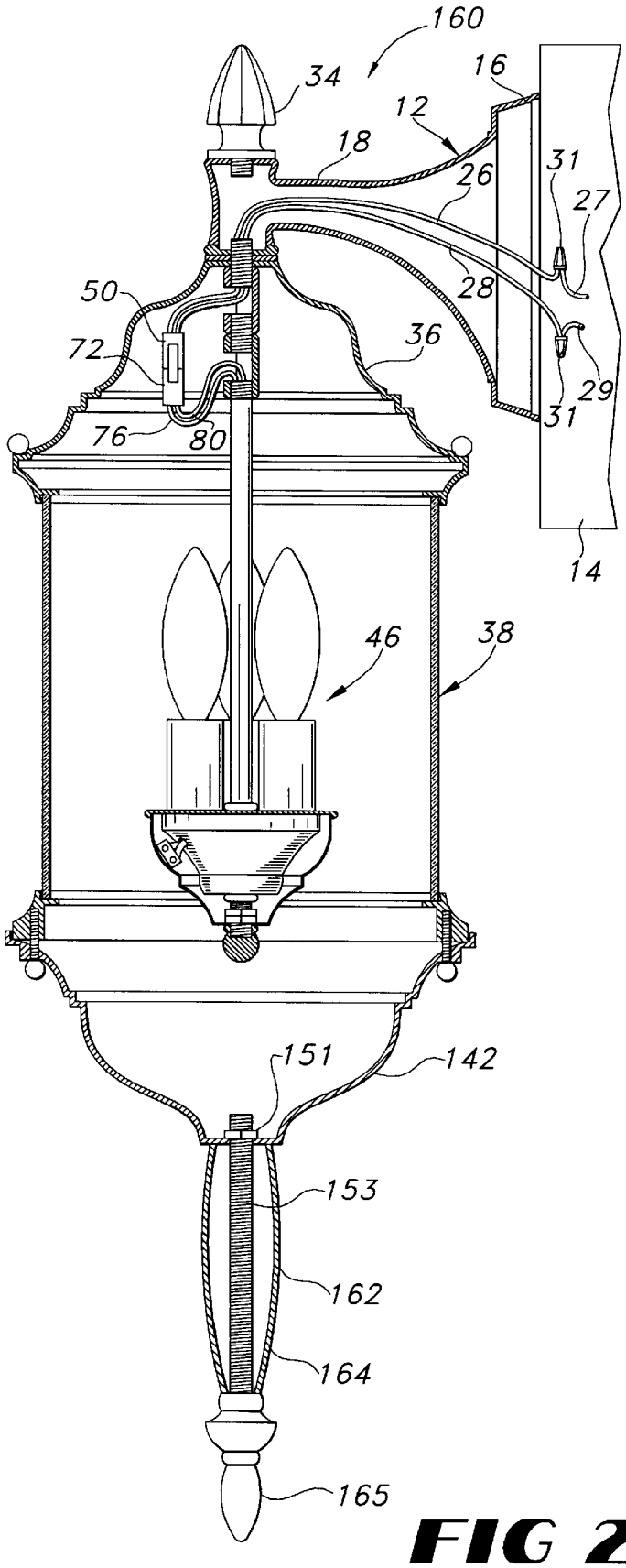
FIG. 23 is a view, partially in cross-section, taken generally along line 23—23 in FIG. 21.

FIGS. 21–23 illustrate a convertible modular lantern 160 according to a third embodiment of the present invention. Lantern 160 is the same as lantern 140 discussed previously except as noted in the following paragraphs. The decorative finial 34 attached to housing 142 of lantern 140 is replaced by a tail 162 which is attached to the lower housing 142 of lantern 160 via a threaded nipple 153 having external threads. Nipple 153 extends longitudinally through a hollow, elongated body portion 164 of tail 162 and is threaded into a lower portion 165 of tail 162 An upper portion of nipple 153 extends into the hollow interior of the lower housing 142 and is secured with a nut 151, thereby attaching the tail 162 to the lower housing 142.

As shown in FIGS. 21 and 22, lantern 160 may include a finial 152 attached to the arm 18 of the mount assembly 12, similar to the configuration of lantern 140 shown in FIG. 18. Alternatively, lantern 160 may optionally include an acorn finial 34 as shown in FIG. 23, in lieu of finial 152, similar to the configuration of lantern 140 shown in FIG. 20.

Figure 24:
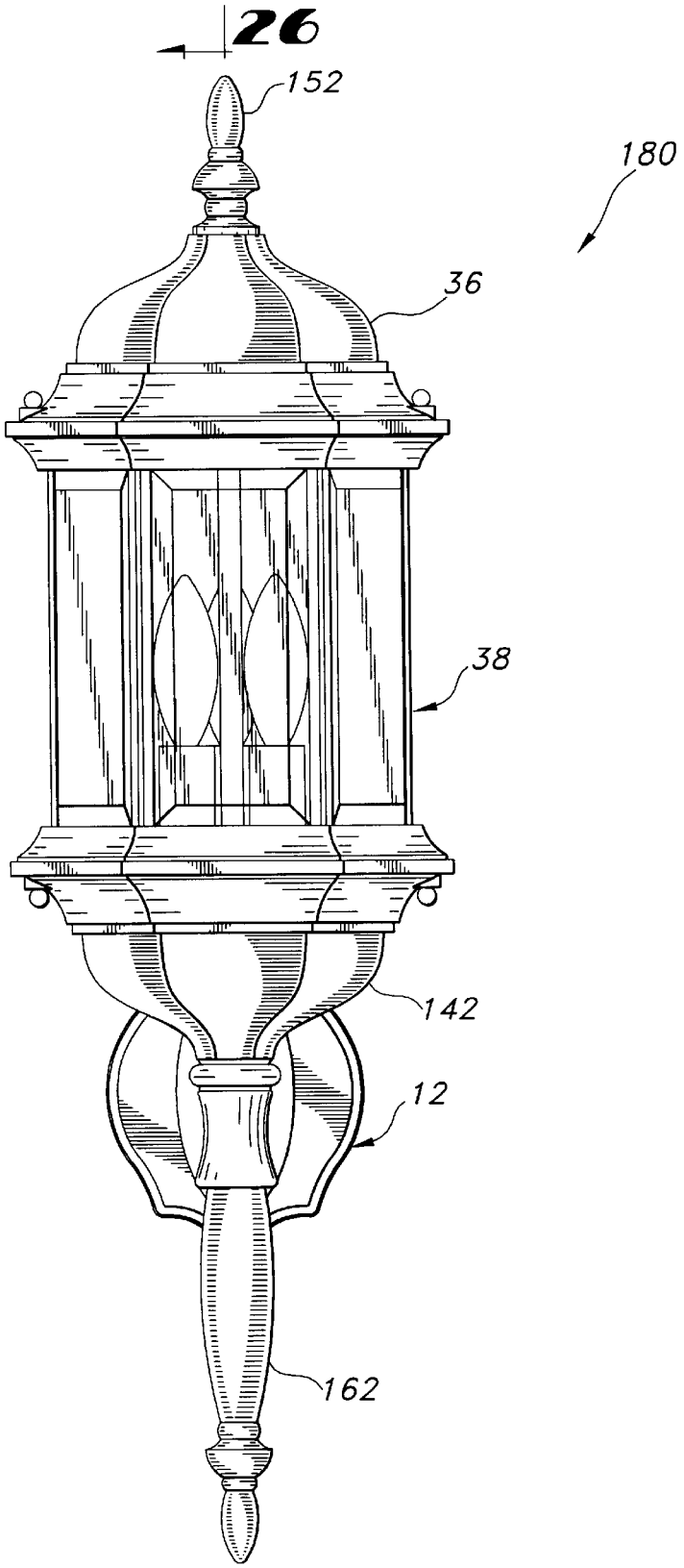
FIG. 24 is a front elevational view of a convertible modular lantern according to a fourth embodiment of the present invention.
Figure 25:
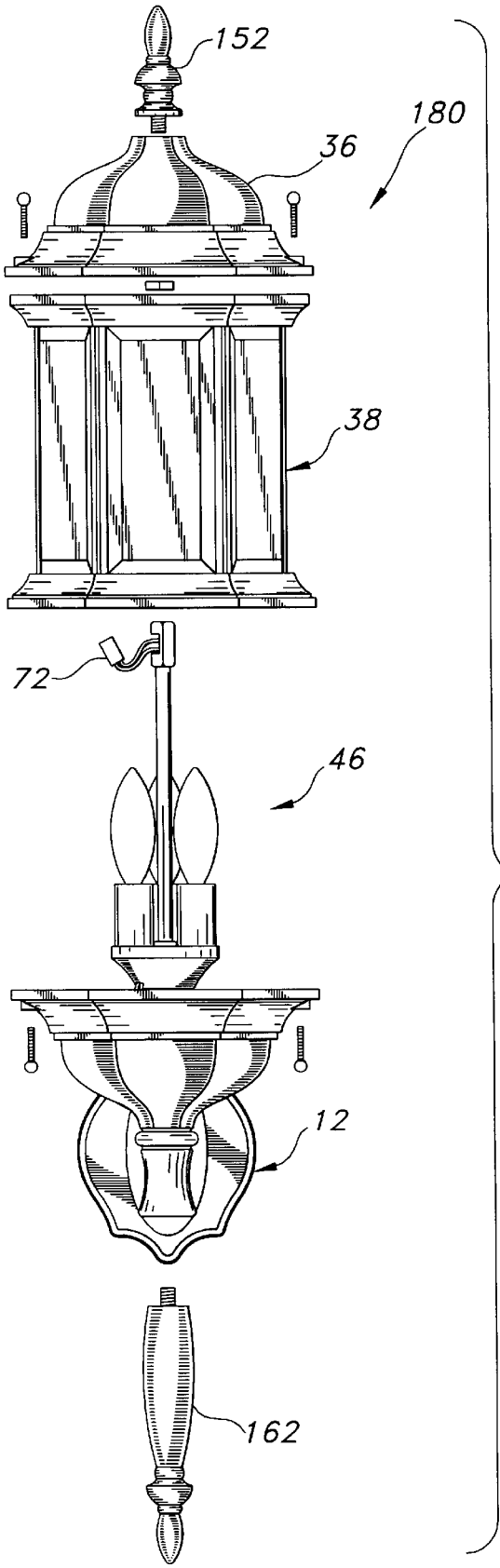
FIG. 25 is an exploded assembly view of the lantern shown in FIG. 24.
Figure 26:
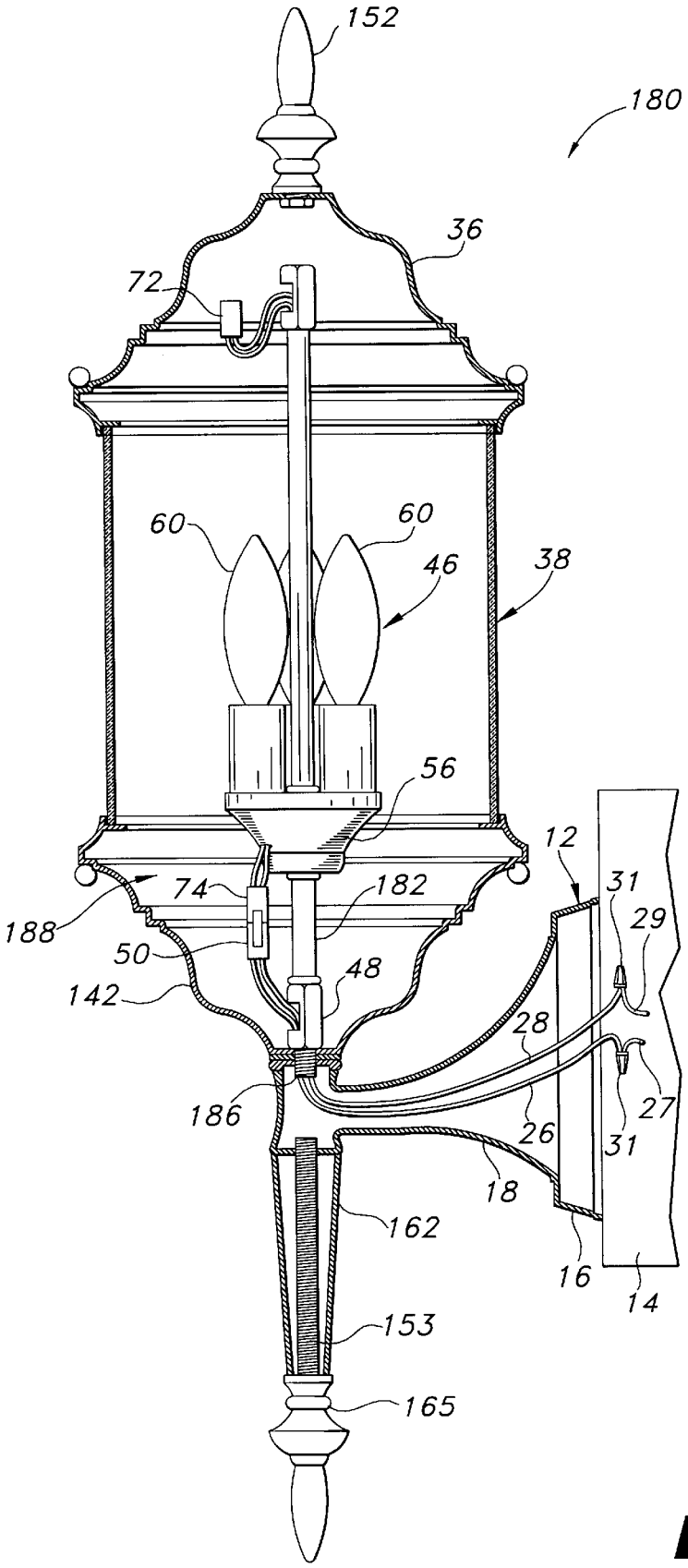
FIG. 26 is a view, partially in cross-section, taken generally along line 26—26 in FIG. 24.

FIGS. 24–26 illustrate a convertible modular, lantern 180 according to a fourth embodiment of the present invention. Unlike lanterns 10, 140 and 160, which are high outlet configuration lanterns, lantern 180 is a standard, or low outlet configuration lantern, due to the location of the mount assembly 12, the connector with which connector 50 is engaged, and the routing of wires 26 and 28 within lantern 180. More particularly, lantern 180 is the same as lantern 160 except as noted in the following discussion. The mount assembly 12 is not attached to the upper housing 36, but instead the arm 18 of mount assembly 12 is attached directly to the bottom housing 142 as best seen in FIG. 26. Accordingly, the finial 152 is threaded directly to upper housing 36 and the distal end portion 20 of arm 18 is mounted directly to the lower housing 142 and is disposed intermediate the lower housing 142 and the tail 162 The tail 162 mounts to a lower portion of the distal end portion 20 via threaded nipple 150.

As best seen in FIG. 26, the upper block connector 72 of the downrod and light cluster assembly 46 is disconnected from block connector 50 and instead block connector 50 is electrically connected to the lower block connector 74 of assembly 46. In order to accommodate this connection, the downrod and light cluster assembly 46 does not include the outer cup 90 which was included in lanterns 10, 140 and 160 discussed previously. As shown in FIG. 26, a hollow rod 182 is attached to a lower end of the inner cup 56 and extends downwardly therefrom and an open coupling 48 is threaded to a lower end of rod 182. A hollow threaded nipple 186 is threaded to a lower end of coupling 48 and is used to attach the distal end portion 20 of arm 18 to the bottom housing 142. Electrical wires 26 and 28 are attached to block connector 50 as discussed previously, and are routed through a notch or opening in the open coupling 48, through the hollow threaded nipple 186, and through the hollow interior of mount assembly 12. As shown in FIG. 26, connectors 50 and 74 are disposed within a cavity 188 formed by the lower housing 146 Like the previous embodiments of the lantern of the present invention, wires 26 and 28 are electrically coupled to the source of 120 vac electrical power available within the structure, via wires 27 and 29, respectively, thereby completing the electrical circuit and providing electrical power to the candelabra based light bulbs 60.

Figure 27:
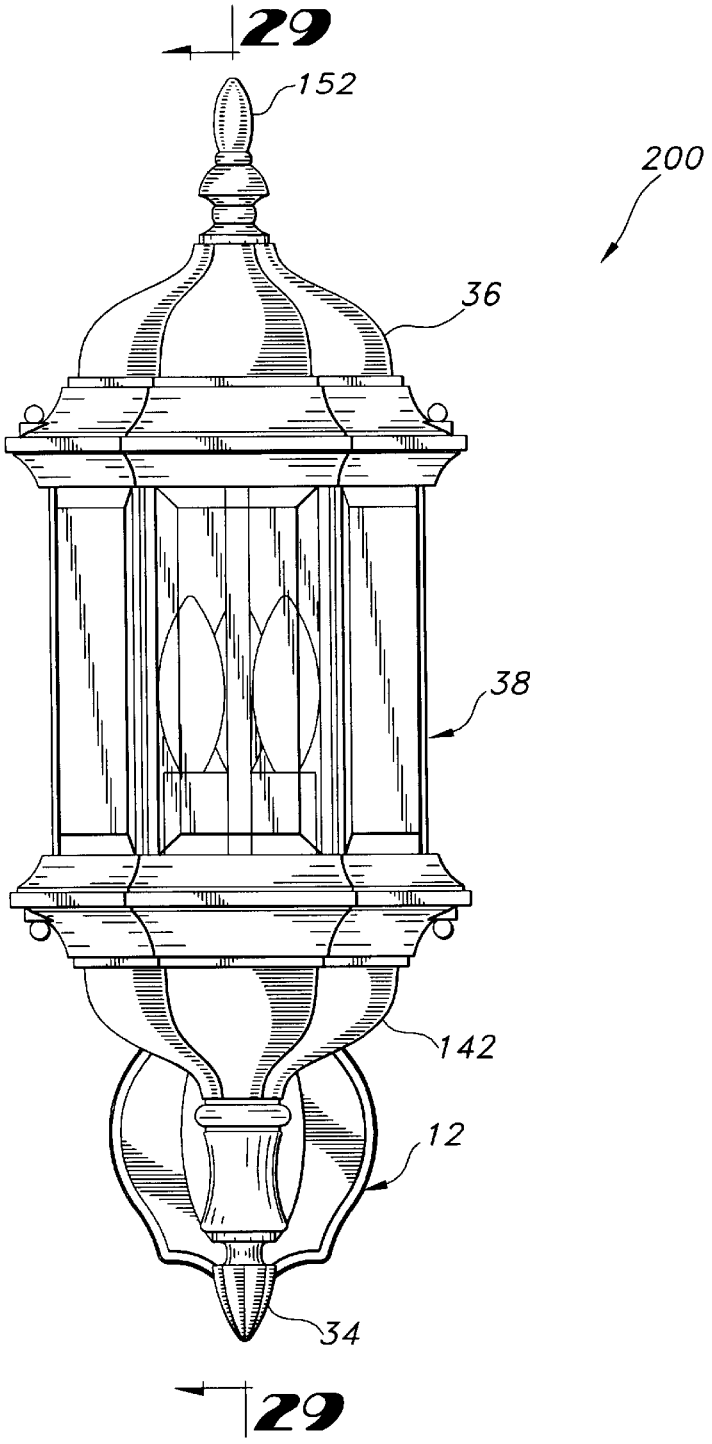
FIG. 27 is a front elevational view of a convertible modular lantern according to a fifth embodiment of the present invention.
Figure 28:
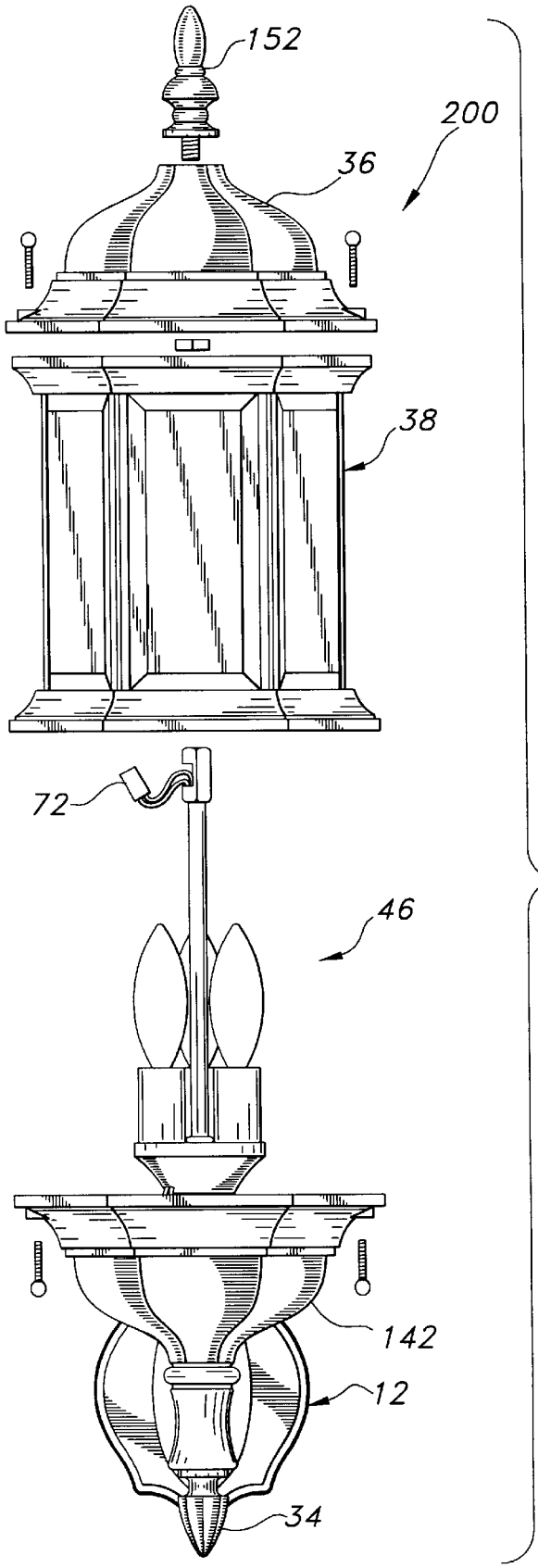
FIG. 28 is an exploded assembly view of the lantern shown in FIG. 27.
Figure 29:
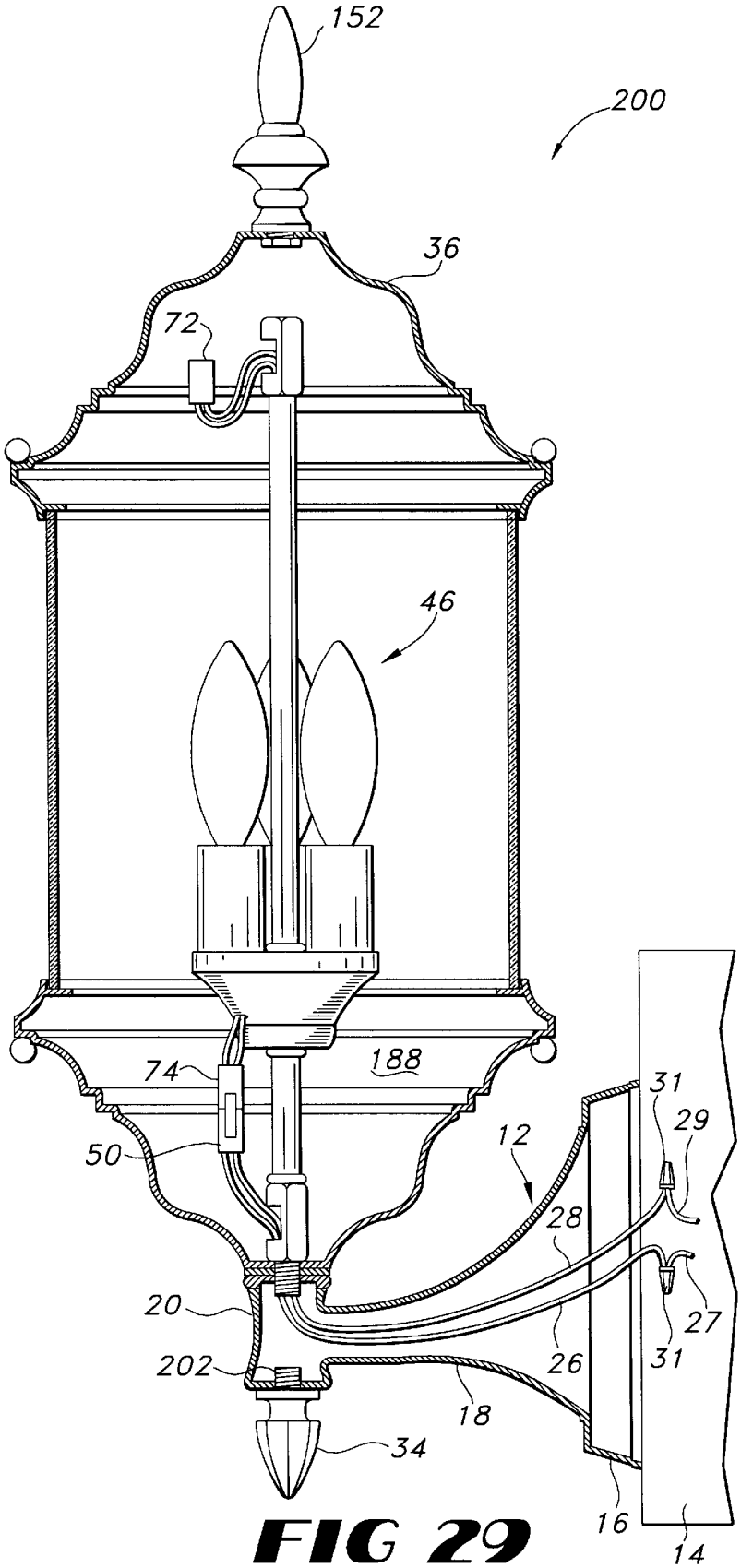
FIG. 29 is a view, partially in cross-section, taken generally along line 29—29 in FIG. 27.

FIGS. 27–29 illustrate a convertible modular lantern 200 according to a fifth embodiment of the present invention. Like lantern 180 lantern 200 is also a standard, or low outlet configuration lantern. More particularly, lantern 200 is the same as lantern 180 except as noted in the following discussion. The tail 162 of lantern 180 is replaced by an acorn finial 34 which is threaded to a lower portion of the distal end portion 20 of mount assembly 12 of lantern 200 via a threaded nipple 202. Alternatively, the tail 162 of lantern 180 may be replaced with a finial having a different shape such as finial 152. As seen by comparing FIGS. 27–29 to FIGS. 24–26, lantern 200 has a distinctive appearance which is different than that of lantern 180 The wires 26 and 28 are routed from connector 50 to the junction box 14 in the same manner as discussed previously with respect to lantern 180.

Each embodiment of the lantern of the present invention is "wall-mountable," i.e., each embodiment may be mounted to the electrical junction box included in a wall of a residential or commercial structure. Also, each embodiment may be mounted directly to the wall of the structure as discussed previously. Furthermore, although each embodiment of the lantern of the present invention may be used in indoor or outdoor applications, the disclosed embodiments of the lantern of the present invention have particular application for outdoor use. This is particularly true for the embodiments where the mount assembly 12, upper housing 36, frame 120 of shade assembly 38 and the lower housing 142 (if used) are constructed of cast aluminum which does not rust or fade as a result of outdoor use. However, even in those embodiments which utilize other materials of construction for the foregoing components, the convertible modular lantern of the present invention is suitable for outdoor use since it is configured to achieve at least a "U.L. (Underwriters Laboratories) damp" rating, and, with the addition of elastomeric seals (not shown) at selected locations, may have a "U.L. wet" rating.

As may be seen from the previous discussion and illustrations, the downrod and light cluster assembly 46 and connector 50 are common to each embodiment of the convertible modular lantern of the present invention and comprise an important feature of the present invention. Incorporation of connector 50 and assembly 46, with the upper connector 72 and lower connector 74 permits a user to create either a high outlet or low outlet configuration lantern by electrically connecting the appropriate one of connectors 72 and 74 to the connector 50 which is electrically coupled, upon installation, to the source of 120 vac electrical power available within the residential or commercial structure to which the lanterns of the present invention may be mounted. Importantly, either a low or high outlet lantern configuration may be achieved with the light bulbs of assembly 46 disposed in a "base-down" burning position, i.e. with the top of each light bulb disposed vertically above the base of the light bulb. This is very important when candelabra based light bulbs are used for the following reason. As known in the art, the service life of candelabra based light bulbs is significantly improved when they are disposed in a "base-down" burning configuration as compared to a "base-up" burning configuration (one in which the base of the bulb is above the top of the bulb). When candelabra based light bulbs are operated in a base-up burning configuration the bases of the bulbs typically become overheated, thereby significantly reducing the service life of the bulbs. This problem is less pronounced when medium based bulbs are used.

Additionally, the use of interchangeable parts in the various embodiments of the convertible modular lantern of the present invention allow a user to create a wide variety of distinctly differing "looks" or variations of a lantern. As disclosed in this document, at least five different basic configurations may be achieved, with additional variations achieved by substituting alternate finial designs and materials of constructions. This ability to create a wide variety of different looks or variations of a lantern, such as an outdoor lantern, is extremely important to a retailer who would have to stock at least three and possibly five different lanterns to achieve the various looks or variations that are possible with the convertible modular lantern of the present invention, if the retailer were to use existing conventional lanterns. This allows the retailer to save shelf space and sell other profitable product. This is referred to in the art as "s.k.u. reduction" and is very important as it greatly increases the value of the retailer's shelf space. The convertible modular lantern of the present invention is also valuable to wholesale customers who sell to professionals who install the lantern on residential homes. Using conventional lanterns, an electrician would typically have to purchase many different styles of lanterns to achieve the varying configuration of the modular lantern of the present invention, which may be required in a new subdivision for instance where a variety of distinctly differing lanterns are desirable.

Furthermore, the incorporation of the downrod and light cluster assembly 46 and connector 50 in combination with other interchangeable parts of the various embodiments of the convertible modular lantern of the present invention facilitate converting from one configuration of lantern to another. For instance, if a user has a high outlet, open bottom lantern configured as lantern 10 and desires a high outlet, closed bottom lantern, this may be accomplished easily with the addition of a lower housing 142 in the manner discussed previously. As another example, if an end user or a professional desires to convert from the high outlet, open bottom lantern 10 to a low outlet, closed bottom lantern, this may be easily accomplished as follows. The upper connector 72 of the downrod and light cluster assembly is disconnected from connector 50 and assembly 46 is disconnected mechanically from the upper housing 36. Due to the symmetry of shade assembly 38, and since the upper housing 36 may have the same shape as lower housing 142, the mount assembly 12, housing 36 and shade assembly 38 may be re-oriented or rotated 180° as a sub-assembly relative to the downrod and light cluster assembly 46 so that housing 36 becomes a lower housing. Assembly 46 is then re-connected mechanically to housing 36, connector 50 is connected to lower connector 74 and a top or upper housing is attached to shade assembly 38. Other configuration changes are also within the scope of the present invention as may be appreciated from the foregoing discussion and illustration of lanterns 10, 140, 160, 180 and 200.

In view of the foregoing, according to a second aspect of the present invention, the invention comprises a kit of modular lantern parts which permits the end user to achieve at least five different basic configurations, corresponding to lanterns 10, 140, 160, 180 and 200, discussed and illustrated previously. Accordingly, the kit of parts may include a mount assembly 12, an upper housing 36, a shade assembly 38, a downrod and light cluster assembly 46 with the included upper electrical connector 72 and lower electrical connector 74, an electrical connector 50 which may be used to engage with one of the connectors 72 and 74, a lower housing 142, a tail 162, one or more acorn finials 34; one or more finials 152 and sufficient fasteners to attach the foregoing components to one another as discussed previously. The fasteners may include threaded screws, open couplings (such as coupling 48), and a variety of threaded nipples (such as nipples 32, 150 and 153) and threaded rods (such as rod 139). It should be understood that the kit may include components which are equivalents of the particular components listed.

While the foregoing description has set forth the preferred embodiments of the present invention in particular detail, it must be understood that numerous modifications, substitutions and changes can be undertaken without departing from the true spirit and scope of the present invention.

What is claimed is:

1. A convertible modular lantern, comprising:

a mount assembly;

a housing connected to and supported by the mount assembly;

a downrod and light cluster assembly mechanically connected to said housing; and a shade assembly attached to said housing and disposed in surrounding relationship with said downrod and light cluster assembly, at least a portion of said shade assembly permitting the transmission of light therethrough;

said downrod and light cluster assembly including a support member and at least one lamp socket mounted on said support member and a light bulb disposed in each of said at least one lamp socket, said downrod and light cluster assembly further including a hollow downrod attached to and extending upwardly from said support member and a first plurality of electrical wires, each of said first plurality of electrical wires being electrically coupled at one end thereof to each of said lamp sockets and extending upwardly within said hollow downrod, said downrod and light cluster assembly further including a second plurality of electrical wires, each of said second plurality of electrical wires being electrically coupled at one end thereof to each of said lamp sockets;

said downrod and light cluster assembly further including an upper electrical connector and a lower electrical connector, said first plurality of electrical wires terminating at an opposite end thereof in said upper electrical connector, said second plurality of electrical wires terminating at an opposite end thereof in said lower electrical connector;

said lantern further including a third electrical connector, said third electrical connector being engaged with and electrically connected to one of said upper and lower electrical connectors, said lantern further including a third plurality of wires connected to and extending from said third electrical connector.

2. The convertible modular lantern as recited in claim 1, wherein:

said upper said electrical connector, said lower electrical connector and said third electrical connector each comprise an electrical block connector.

3. The convertible modular lantern as recited in claim 1, wherein:

said upper electrical connector, said lower electrical connector and said third electrical connector each comprise a keyed electrical block connector.

4. The convertible modular lantern as recited in claim 1, wherein:

said upper electrical connector and said lower electrical connector each comprise a female, keyed electrical block connector, said third electrical connector comprising a male, keyed electrical block connector.

5. The convertible modular lantern as recited in claim 1, wherein:

said housing comprises an upper housing, said mount assembly being connected to an upper portion of said upper housing;

said third electrical connector is electrically connected to said upper electrical connector;

said upper housing is attached to an upper portion of said shade assembly; and said lantern further includes a decorative finial attached to said mount assembly proximate said upper housing.

6. The convertible modular lantern as recited in claim 5, further comprising:

a lower housing attached to a lower portion of said shade assembly.

7. The convertible modular lantern as recited in claim 6, further comprising:

a second decorative finial, said second decorative finial being attached to said lower housing.

8. The convertible modular lantern as recited in claim 6, further comprising:

a tail attached to and extending downwardly from said lower housing.

9. The convertible modular lantern as recited in claim 1, wherein:

said housing comprises a lower housing, said mount assembly being attached to a lower portion of said lower housing;

said third electrical connector is electrically connected to said lower electrical connector;

said lower housing is attached to a lower portion of said shade assembly.

10. The convertible modular lantern as recited in claim 9, further comprising:

an upper housing attached to an upper portion of said shade assembly and a decorative finial attached to an upper portion of said upper housing.

11. The convertible modular lantern as recited in claim 10, further comprising:

a second decorative finial attached to said mount assembly proximate said lower housing.

12. The convertible modular lantern as recited in claim 10, further comprising:

a tail attached to said mount assembly proximate said lower housing.

13. The convertible modular lantern as recited in claim 1, wherein:

said mount assembly includes a hollow backplate and a hollow arm connected to and extending away from said backplate, said arm including a distal end portion;

said distal end portion being attached to said housing.

14. The convertible modular lantern as recited in claim 13, wherein:

said third plurality of wires connected to and extending from said third connector is routed through said hollow arm and said hollow backplate of said mount assembly.

15. The convertible modular lantern as recited in claim 13, wherein:

said hollow backplate and said hollow arm are made as a one piece construction.

16. The convertible modular lantern as recited in claim 15, wherein:

said hollow backplate and said hollow arm comprise a one piece casting.

17. The convertible modular lantern as recited in claim 1, wherein:

said shade assembly has a polygonal cross-sectional shape.

18. The convertible modular lantern as recited in claim 17, wherein:

said shade assembly has a hexagonal cross-sectional shape.

19. The convertible modular lantern as recited in claim 1, wherein:

said shade assembly includes a frame and a plurality of light transmitting panels;

said frame is attached to said housing;

said light transmitting panels are retained in position by said frame.

20. The convertible modular lantern as recited in claim 19, wherein:

said frame includes an upper flange, a lower flange and a plurality of substantially vertically extending members attached to and interconnecting said upper and lower flanges;

one of said upper and lower flanges is attached to said housing;

said lower flange includes an inner shelf portion with a central opening formed therein.

21. The convertible modular lantern as recited in claim 20, wherein each of said substantially vertically extending members of said frame is disposed between an adjacent pair of said light transmitting panels.

22. The convertible modular lantern as recited in claim 1, wherein:

said at least one lamp socket comprises three of said lamp sockets and each of said light bulbs comprises a candelabra based light bulb.

23. The convertible modular lantern as recited in claim 1, wherein:

said downrod is attached at a lower end thereof to said support member;

said downrod and light cluster assembly further includes a hollow inner cup attached to said support member, said inner cup including an aperture formed therethrough;

said second plurality of wires is routed through said aperture whereby said lower electrical connector is disposed exterior of said inner cup.

24. The convertible modular lantern as recited in claim 23, wherein:

said downrod and light cluster assembly further includes a hollow outer cup which is disposed in surrounding relationship with said inner cup, said outer cup being attached to a lower end of said inner cup;

said inner cup and said outer cup form a cavity therebetween, said lower electrical connector being disposed in said cavity.

25. The convertible modular lantern as recited in claim 23, wherein:

said support member comprises a plate.

26. A convertible modular lantern for installation on a structure, the structure having a source of 120 vac electrical power, said lantern comprising:

a mount assembly which is mounted to the structure;

a housing connected to and supported by the mount assembly;

a downrod and light cluster assembly mechanically connected to said housing; and a shade assembly attached to said housing and disposed in surrounding relationship with said downrod and light cluster assembly, at least a portion of said shade assembly permitting the transmission of light therethrough;

said downrod and light cluster assembly including a support member and at least one lamp socket mounted on said support member and a light bulb disposed in each of said at least one lamp socket, said downrod and light cluster assembly further including a hollow downrod attached to and extending upwardly from said support member and a first plurality of electrical wires, each of said first plurality of electrical wires being electrically coupled at one end thereof to each of said lamp sockets and extending upwardly within said hollow downrod, said downrod and light cluster assembly further including a second plurality of electrical wires, each of said second plurality of electrical wires being electrically coupled at one end thereof to each of said lamp sockets;

said downrod and light cluster assembly further including an upper electrical connector and a lower electrical connector, said first plurality of electrical wires terminating at an opposite end thereof in said upper electrical connector, said second plurality of electrical wires terminating at an opposite end thereof in said lower electrical connector;

said lantern further including a third electrical connector and a third plurality of electrical wires connected to and extending from said third electrical connector;

said third electrical connector being electrically connected to one of said upper electrical connector and said lower electrical connector of said downrod and light cluster assembly and said third plurality of wires being electrically connected to the source of 120 vac power of the structure, thereby operatively illuminating said light bulb disposed in said at least one lamp socket.

27. The convertible modular lantern as recited in claim 26, wherein:

said housing and said mount assembly each include a hollow interior;

said third electrical connector is disposed within said hollow interior of said housing;

said third plurality of electrical wires is routed from said third electrical connector through said hollow interior of said mount assembly to the source of 120 vac electrical power of the structure.

28. The convertible modular lantern as recited in claim 27, wherein:

said mount assembly includes a hollow backplate and a hollow arm connected to and protruding from said backplate, said arm including a distal end portion being attached to said housing;

said third plurality of electrical wires is routed through said hollow arm and said hollow backplate of said mount assembly.

29. The convertible modular lantern as recited in claim 28, wherein the structure includes an electrical junction box;

said hollow backplate is mounted to the electrical junction box.

30. The convertible modular lantern as recited in claim 26, wherein:

said upper electrical connector, said lower electrical connector and said third electrical connector each comprise an electrical block connector.

31. The convertible modular lantern as recited in claim 26, wherein:

said upper electrical connector, said lower electrical connector and said third electrical connector each comprise a keyed, electrical block connector.

32. The convertible modular lantern as recited in claim 26, wherein:

said upper electrical connector and said lower electrical connector each comprise a female, keyed electrical block connector, said third electrical connector comprising a male, keyed electrical block connector.

33. The convertible modular lantern as recited in claim 26, wherein:

said housing comprises an upper housing, said mount assembly being connected to an upper portion of said upper housing;

said third electrical connector is electrically connected to said upper electrical connector;

said upper housing is attached to an upper portion of said shade assembly; and said lantern further includes a decorative finial attached to said mount assembly proximate said upper housing.

34. The convertible modular lantern as recited in claim 33, further comprising:

a lower housing attached to a lower portion of said shade assembly.

35. The convertible modular lantern as recited in claim 34, further comprising:

a second decorative finial, said second decorative finial being attached to said lower housing.

36. The convertible modular lantern as recited in claim 34, further comprising:

a tail attached to and extending downwardly from said lower housing.

37. The convertible modular lantern as recited in claim 33, wherein:

said lantern further includes an interior cavity formed by said upper housing and said shade assembly;

said first plurality of wires exits from said hollow downrod into said interior cavity whereby said upper electrical connector is disposed within said interior cavity;

said mount assembly includes a hollow interior;

said third electrical connector and said upper electrical connector are disposed within said interior cavity, said third plurality of electrical wires being routed from the third electrical connector and through the hollow interior of the mount assembly to the source of 120 vac electrical power of the structure.

38. The convertible modular lantern as recited in claim 26, wherein:

said housing comprises a lower housing, said mount assembly being attached to a lower portion of said lower housing; and said third electrical connector is electrically connected to said lower electrical connector;

said lower housing is attached to a lower portion of said shade assembly.

39. The convertible modular lantern as recited in claim 38, further comprising:

an upper housing attached to an upper portion of said shade assembly and a decorative finial attached to an upper portion of said upper housing.

40. The convertible modular lantern as recited in claim 39, further comprising:

a second decorative finial attached to said mount assembly proximate said lower housing.

41. A kit of component parts for a convertible modular lantern, comprising:

a mount assembly;

at least one housing coupled to said mount assembly;

a shade assembly coupled to said housing;

a downrod and light cluster assembly coupled to said housing, said downrod and light cluster assembly including a support member and at least one lamp socket mounted on said support member and a light bulb disposed in each of said at least one lamp socket, said downrod and light cluster assembly further including a hollow downrod attached to and extending away from said support member and a first plurality of electrical wires, each of said first plurality of electrical wires being electrically coupled at one end thereof to each of said lamp sockets and extending within said hollow downrod, said downrod and light cluster assembly further including a second plurality of electrical wires, each of said second plurality of electrical wires being electrically coupled at one end thereof to each of said lamp sockets;

said downrod and light cluster assembly further including an upper electrical connector and a lower electrical connector, said first and second plurality of electrical wires terminating in said upper and lower electrical connectors, respectively;

said kit further including a third electrical connector and a third plurality of wires connected to and extending from said third electrical connector.

42. The kit of component parts as recited in claim 41, further comprising:

at least one decorative finial coupled to said mount assembly; and a plurality of fasteners including a plurality of open couplings coupling said mount assembly to said downrod and light assembly.

43. The kit of component parts as recited in claim 42, further comprising;

at least one tail coupled to said mount assembly.

44. The kit of component parts as recited in claim 41, wherein:

said at least one housing comprises an upper housing and a lower housing.

45. The kit of component parts as recited in claim 42, wherein:

said plurality of fasteners further includes a plurality of threaded nipples and a plurality of threaded screws.

* * * * *